US005568448A

United States Patent [19]

Tanigushi et al.

[11] Patent Number: 5,568,448

[45] Date of Patent: Oct. 22, 1996

[54] SYSTEM FOR TRANSMITTING A SIGNAL

[75] Inventors: Ryosuke Tanigushi; Shinichi Hattori; Takahiro Sakamoto, all of Nagasaki, Japan

[73] Assignee: Mitsubishi Denki Kabushiki Kaisha, Tokyo, Japan

[21] Appl. No.: 296,884

[22] Filed: Aug. 29, 1994

[30] Foreign Application Priority Data

Apr. 25, 1991 [JP] Japan ..... 6-086941

[51] Int. Cl.[6] ..... H04H 9/00

[52] U.S. Cl. ..... 367/82; 367/156; 367/168; 175/40

[58] Field of Search ..... 367/76, 81, 82, 367/156, 168; 175/40; 166/250

[56] References Cited

U.S. PATENT DOCUMENTS

| | | | |
|---|---|---|---|
| 3,633,403 | 1/1972 | McDonald | 73/15.6 |
| 3,697,940 | 10/1972 | Berka | 181/5 |
| 3,961,308 | 6/1976 | Parker | 175/48 |
| 4,283,780 | 8/1981 | Nardi | 367/82 |
| 4,293,936 | 10/1981 | Cox et al. | 367/82 |
| 4,646,999 | 1/1987 | Lygas | 367/156 |
| 5,022,014 | 6/1991 | Kulczyk et al. | 367/87 |

FOREIGN PATENT DOCUMENTS

| | | |
|---|---|---|
| 0552833 | 7/1993 | European Pat. Off. . |
| 56-125595 | 10/1981 | Japan . |
| 62-2113 | 1/1987 | Japan . |

OTHER PUBLICATIONS

Grudzinski et al, "Telemetry Using the Propagation of an Electromagnetic Wave Along a Drill Pipe String", Louisiana State University, Baton Rouge, LA, Feb. 26–27, 1990, pp. 66–74.

A. Jitsumori et al., "Measured Data Transmission Technique at Underground in Oil Excavation", *IEEE Journal Japan,* vol. 112, No. 11, 1992, pp. 877–884.

A. Kawabata, "Ultrasonic Transducer", *Measurement and Control,* vol. 28, No. 5, May 1989, pp. 398–403.

*Primary Examiner*—J. Woodrow Eldred

*Attorney, Agent, or Firm*—Burns, Doane, Swecker & Mathis, LLP

[57] ABSTRACT

A magnetostrictive element generates an ultrasonic wave and the generated ultrasonic wave is propagated through a propagation medium. An acoustic wave receiver receives the propagated ultrasonic wave at the other end of the propagation medium and converts it into an electric signal. A signal transmission is carried out in this way.

25 Claims, 27 Drawing Sheets

FIG. 7 (1) (PRIOR ART)
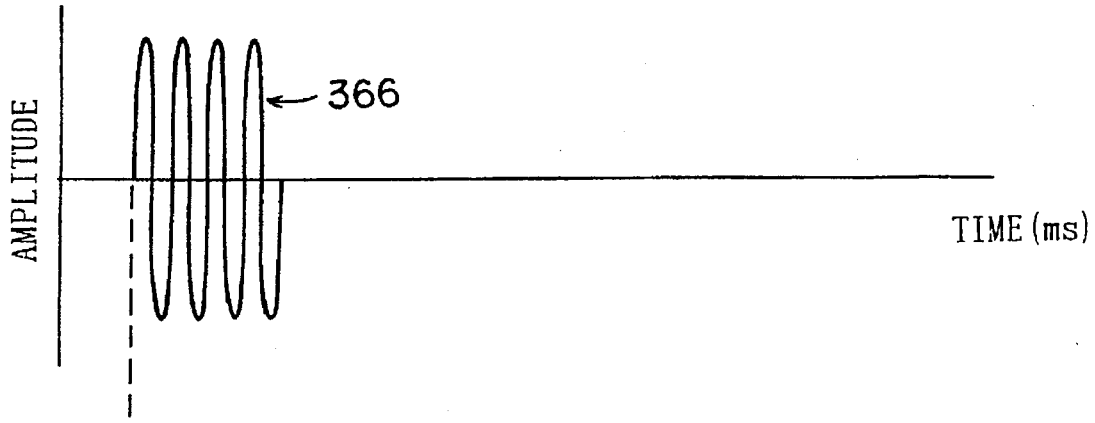
FIG. 7 (2) (PRIOR ART)
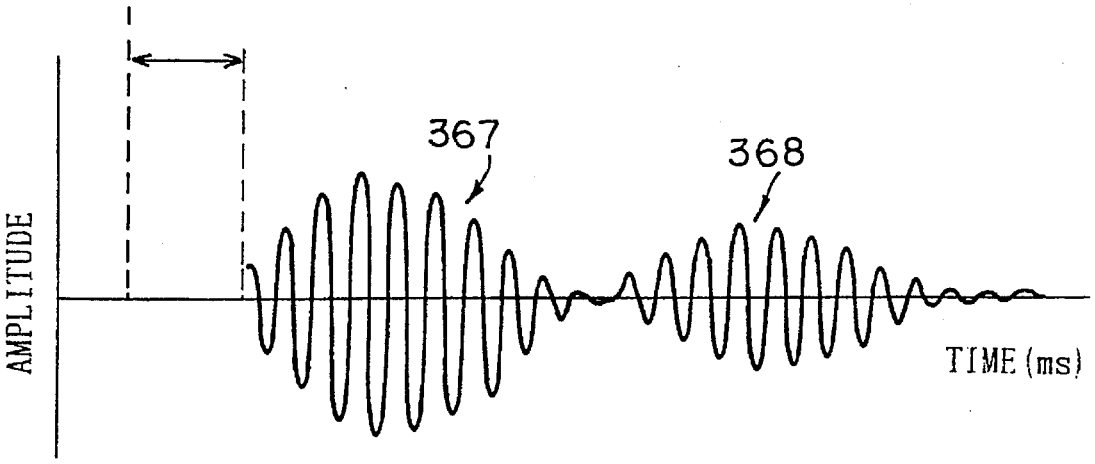

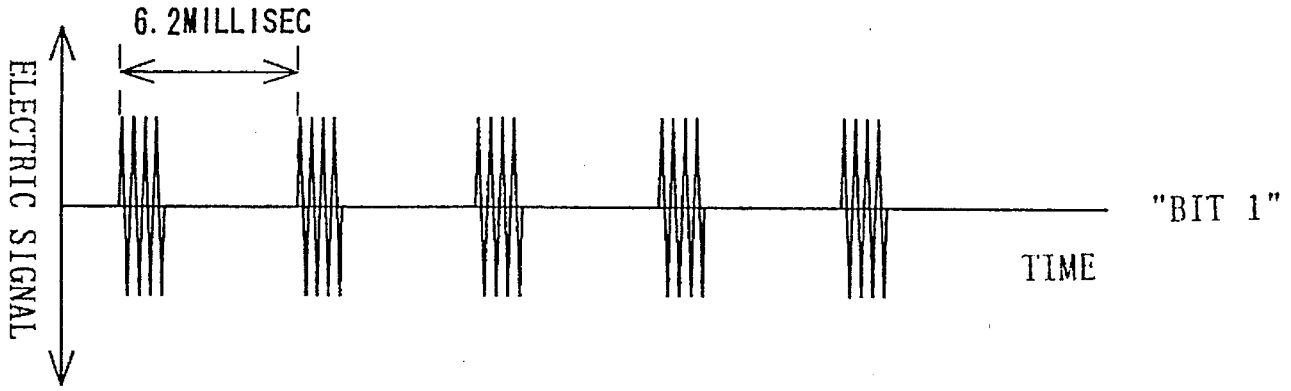
FIG. 8 (1)
(PRIOR ART)
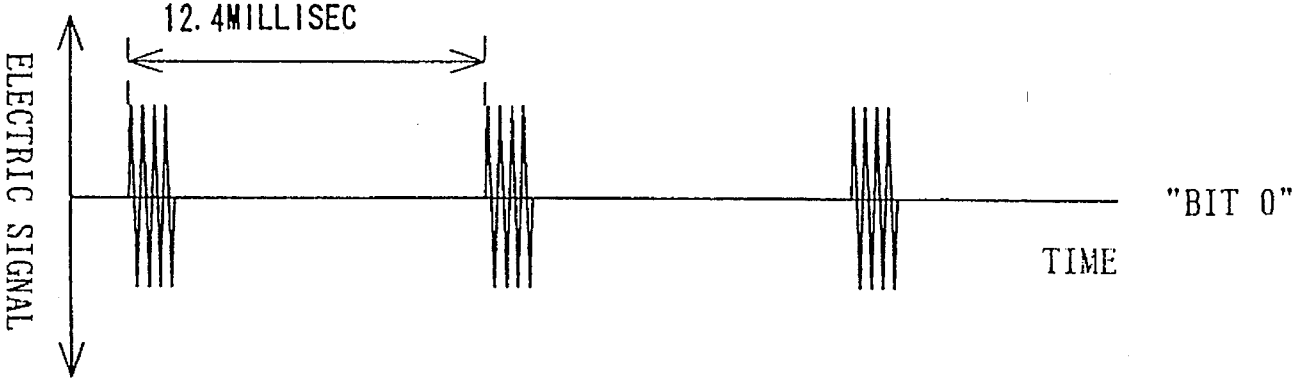
FIG. 8 (2)
(PRIOR ART)

FIG. 17 (1)
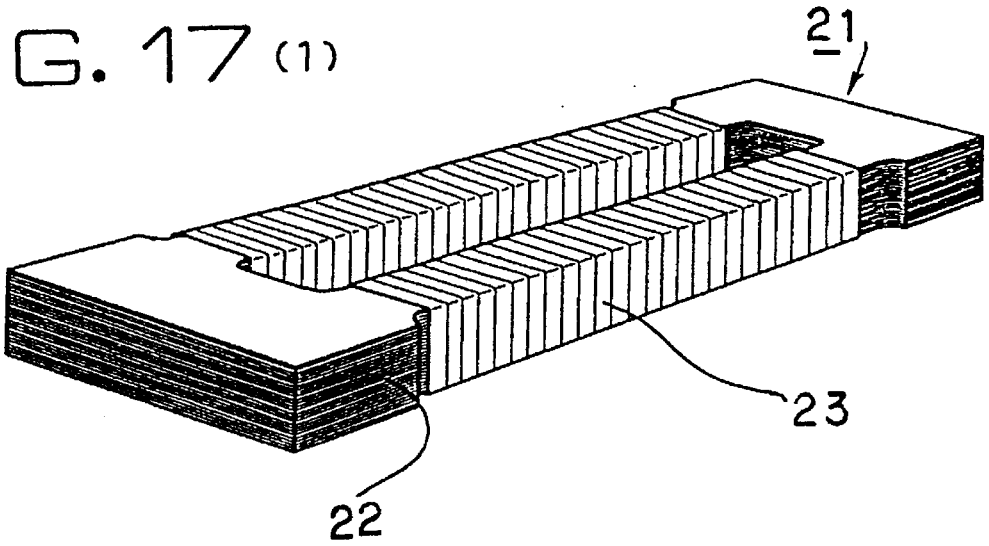
FIG. 17 (2)
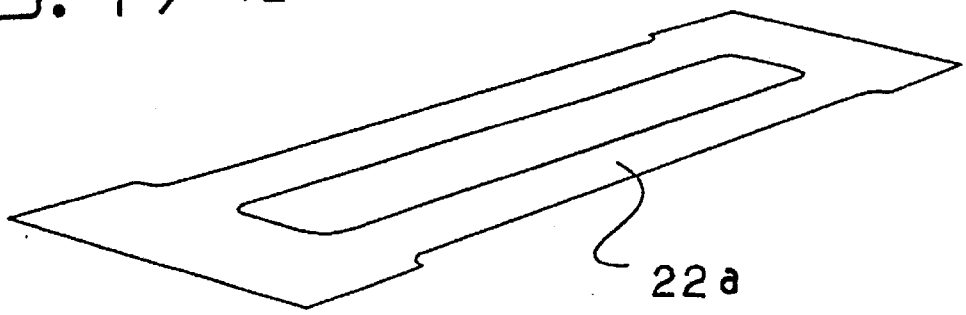

SYSTEM FOR TRANSMITTING A SIGNAL

BACKGROUND OF THE INVENTION

1. Field of the Invention

The present invention relates to a system of transmitting an information signal such as an underground information signal suitable for use in drilling a crude petroleum well or a gas well for example, wherein the information signal is transmitted to the ground in real time.

2. Description of the Related Art

In recent years, an MWD (Measurement While Drilling) system for transmitting stratum information and drilling information to the ground in real time while drilling has been used to effect a reduction in drilling cost and an improvement in safety while and immediately obtaining the drilling information so that drilling control is effected. The details of the MWD technology have been described in, e.g., a Journal, Vol. 112, No. 11, pp. 877–884 (issued in 1992) published by IEE of Japan.

FIGS. 1, 2 and 3 are respectively general views for describing a conventional system for transmitting a signal. In the drawings, reference numeral 101 indicates a drilling rig provided on the ground. Reference numeral 102 indicates a drill pipe supported by the drilling rig 101 and rotated in a pit well 100. The drill pipe 102 has a predetermined length (of about 9 meters, for example) and screws attached to both ends thereof. As the pit well 100 becomes deeper upon drilling, subsequent drill pipes 102 are successively added to the initial drill pipe 102 so that the overall length can be increased.

A drill collar 102*a* to be connected with the drill pipes 102 is connected to a leading end portion of a train or sequence (called a "drill string") of the so-added drill pipes 102 as shown in FIG. 2. Further, a drill bit 102*b*, which serves as a cutting blade, is mounted to a leading end portion of the drill collar 102*a* and drills the pit well 100 under the rotation of the connected drill pipe 102.

Reference numeral 103 indicates a mud pump for feeding water (called "mud") mixed with mud into the entire drill pipe 102 from the ground. Reference numeral 103*a* indicates a mud tank for storing muddy water therein. The muddy water in the mud tank 103*a* is fed downward under pressure into the drill pipe 102 by the mud pump 103. After the muddy water has reached to the drill bit 102*b*, it travels or proceeds to the ground through an outer space between the pit well 100 and the drill pipe 102 and is returned to the mud tank 103*a* again.

Reference numerals 105*a* through 105*n* respectively indicate various detectors for detecting information required to drill a bottom of pit. These detectors are mounted to the leading end portion of the drill collar 102*a* and detect the following physical quantities:

(1) load of drill bit, torque of drill bit, bending moment, vibrational values, etc. as drilling information:

(2) bearing (for evaluating whether or not a pit well is being drilled in a predetermined direction), inclination, pressure, temperature, etc. as pit-well information:

(3) stratum gamma-ray density or level, stratum resistivity (electrical resistance), etc. as stratum evaluation information.

Reference numeral 104*b* indicates a modulator attached to the leading end portion of the drill collar 102*a*, for modulating various signals detected by the detectors 105*a* through 105*n*, which are supplied from the bottom hole during drilling and transmitting the modulated signals to a transmitter 104. Reference numeral 104 indicates the transmitter for amplifying the signals supplied from the modulator 104*b* and outputting the amplified signals to a transmitting antenna 104*c*.

Reference numeral 104*a* indicates a generator for supplying operating power to the modulator 104*b* and the detectors 105*a* through 105*n* or the like. Reference numeral 104*g* indicates a moving or rotor blade of a turbine, which rotates according to the flow of muddy water. The generator 104*a* is rotatably driven under the rotation of the moving blade 104*g* so as to generate power. Reference numeral 104*h* indicates a stationary or stator blade of the turbine, for changing the direction of the flow of the muddy water.

A transmission unit (including the transmitter 104, the modulator 104*b*, etc.) and the detectors 105*a* through 105*n* are accommodated within a storage container 104*f* provided within the drill collar 102*a* and are sealed so as to avoid the influence of the muddy water. Further, the generator 104*a* and the turbine are also coupled to an upper portion of the storage container 104*f*.

Reference numeral 104*c* indicates the transmitting antenna attached to a part of an outer peripheral portion of the drill collar 102*a* with both separated by an insulating material 104*e*. The transmitting antenna 104*c* is electrically coupled to the transmitter 104 with a bolt 104*d* insulated by and attached to the drill collar 102*a* so as to extend through the drill collar 102*a*.

Reference numeral 106 indicates a receiving antenna mounted on the ground. Reference numeral 107 indicates a receive amplifier for amplifying a signal received by the receiving antenna 106. Reference numeral 108 indicates a demodulator for demodulating a signal sent from the receive amplifier 107. Reference numeral 109 indicates a data processor for performing signal processing such as A/D conversion on a signal supplied from the demodulator 108 and thereafter performing data processing such as a storage process, a computational process on the value of the so-processed signal. Designated at numeral 110 is a display for displaying data sent from the data processor 109 thereon or indicating a warning thereon.

The operation of the conventional signal transmission system will now be described below. The drilling of petroleum or gas well is carried out by successively connecting the drilling rig 101, the drill pipe 102 and the drill collar 102*a* to one another and rotating the drill bit 102*b* attached to the leading end portion of the drill collar 102*a*. During drilling, on-drilling muddy water stored in the mud tank 103*a* is sent out from the mud pump 103. Further, the muddy water circulates in the mud tank 103*a* through the drill pipe 102, the drill bit 102*b* and a pit wall to thereby deliver drilled debris to the ground.

The transmitter 104 is provided in the bottom hole. When the on-drilling muddy water is fed from the mud pump 103 and reaches a predetermined flow rate, the generator 104*a* mounted to the transmitter 104 is driven and started up by the on-drilling muddy water so as to supply power to the transmitter 104. When the power is supplied to the transmitter 104, data detected by the detectors 105*a* through 105*n* and modulated by the modulator 104b are outputted to the transmitting antenna 104*c* from the transmitter 104. Thereafter, the data are transmitted to the inside of the stratum through the transmitting antenna 104*c* in the form of a radio wave. The radio wave is received by the receiving antenna 106 provided on the ground and subjected to filtering and amplification by the receive amplifier 107, after which the so-processed radio wave is input to the demodulator 108. The demodulator 108 effects a demodulating process on the input signal and demodulates the so-processed signal in the form of the data detected by the detectors 105*a* through 105*n*. The demodulated data are input to the data processor 109 where the input data are checked against ground information such as time, depth, etc. and effects data processing according to display purposes. Thereafter, the processed data are displayed on the display 110.

As has been described in, e.g., "TELEMETRY USING THE PROPAGATION OF AN ELECTROMAGNETIC WAVE ALONG A DRILL PIPE STRING" (MWD SYMPOSIUM PROCEEDINGS pp 49–51, FEB. 26–27 1990, LOUISIANA STATE UNIVERSITY, LOUISIANA) by R. GRUDZINSKI et al., the conventional system for and method of transmitting the radio signal are accompanied by drawbacks that the radio wave is relatively so attenuated in the ground, the achievable distance of the radio wave is short and the radio wave is rendered unfit for the use of a deep well having a distance of 600 meters or so.

In order to solve such drawbacks which arise when the radio wave is used as a signal transmission medium, there has been proposed an acoustic wave type pipe transmission system using a piece of piezoelectric ceramic as a signal transmission source as has been described in EP-A1-0552833.

FIG. 4 is a side view showing the structure of the pipe transmission system disposed in the bottom hole. In the drawing, reference numeral 332 indicates an oscillator or a signal generator using a piezoelectric ceramic element. Reference numeral 334 indicates a receiver sub on the receiving side. Reference numeral 335 indicates a receiving transducer for converting a received acoustic wave into an electric signal. Reference numeral 319 indicates an MWD tool and reference numeral 311 indicates a drill pipe. Designated at numeral 312 is a drill collar.

The operation of the pipe transmission system will now be described. An ultrasonic wave generated from the signal generator 332 is sent to a tubular body or a pipe made up of the drill collar 312 and the drill pipe 311 and is propagated upward. In the conventional example, the ultrasonic wave is received by the receiving transducer 335 on the receiver sub 334 disposed in the course of the pipe. Further, information is transmitted to the ground through the MWD tool 319 in accordance with a method using a mud pulse, for example.

FIG. 5 is an exploded perspective view showing the structure of the signal generator 332. In the drawing, reference numeral 372 indicates a crystal of stacked ceramics. FIG. 6 is a cross-sectional view of the signal generator 332. Reference numeral 353 indicates an elastic body such as a spring or the like. Reference numeral 337 indicates a coupling unit for coupling the signal generator 332 to the pipe. The signal generator 332 is provided in a concave portion defined in the pipe. The signal generator 332 has such as a structure that one end of the coupling unit 337 is pressed against a transverse surface of a drill string and the elastic body 353 applies a biasing force to the crystal 372 so as to cause vibration coupling between vibrations of the signal generator 332 and the pipe.

FIGS. 7(1) and 7(2) are respectively waveform charts for describing the waveform of a drive voltage generated by the signal generator 332 employed in the conventional example shown in FIGS. 4 through 6 and the waveform of a signal propagated through the pipe. Reference numeral 366 indicates a waveform of the drive voltage to the signal generator 332. Reference numerals 367 and 368 respectively indicate the propagated waveforms generated in the pipe.

The signal propagated through the pipe is generated as follows. That is, a carrier wave of a frequency of about 20 kHz corresponding to the resonance frequency of the signal generator 332 is first applied to the ceramic crystal 372 as a four-wave burst voltage so as to excite the ceramic crystal 372. Vibrations of the excited ceramic crystal 372 are then transferred to the pipe via the coupling unit 337, so that an ultrasonic vibration comprised of a longitudinal wave 367 and a transverse wave 368 is created in the pipe.

FIGS. 8(1) and 8(2) are respectively waveform charts for describing modulation of exciting voltage at the signal generator 332. FIG. 8(1) shows the waveform of an exciting voltage signal at the time that a bit is "1". FIG. 8(2) illustrates the waveform of an exciting voltage signal at the time that the bit is "0". Repeat rate of the signals indicates binary code. A first rate corresponds to the bit of "1" and is 6.2 msec in the conventional example in FIG. 8(1), whereas a second rate corresponds to the bit of "0" and is 12.4 msec in the conventional example in FIG. 8(2).

The propagated ultrasonic vibration generated from the signal generator 332 is propagated upward through the drill string and detected by the receiving transducer 335 having the same structure as that of the signal generator 332, so that an output voltage is produced according to vibrations of a piezoelectric crystal of the receiving transducer 335. As an alternative to the receiving transducer 335, a piezoelectric accelerometer is used for the detection of the ultrasonic vibration.

The sound signal detected by the receiving transducer 335 is converted into an electric signal. Thereafter, noise components are removed from the converted electric signal by an unillustrated filter. Further, the noise-removed signal is converted into a digital signal by an unillustrated A/D converter so as to be input to the MWD tool 319. Thereafter, this signal is transmitted to a further upper portion base on a mud pulse, for example.

Since the conventional system for transmitting a signal is constructed using the piezoelectric ceramic in such a manner that the piezoelectric effect of the piezoelectric ceramic is used to generate the acoustic signal, the following problems arise:

(1) The piezoelectric ceramic is weak in strength as compared with a metallic material.

(2) The piezoelectric ceramic has a Curie temperature of about 120° C. Since piezoelectric distortion is not produced when the Curie temperature of the piezoelectric ceramic exceeds 120° C., the piezoelectric ceramic cannot be used under a high-temperature environment.

(3) When a magnetic-field applying direction coincides with a crystal distortion axis and a pre-load for applying pressure in advance is put on the piezoelectric ceramic, a stress is imposed on electrodes so that the electrodes are apt to suffer damage.

(4) An oscillating frequency of the piezoelectric ceramic is fixed depending on dimensions such as the thickness of the piezoelectric ceramic, etc. That is, it is necessary to carry out excitation under the oscillating frequency corresponding to the dimensions. It is indispensable to efficiently inject impactive energy enough to generate an acoustic wave into the pipe.

(5) Even when the exciting voltage is modulated at the repeat rate, the carrier wave is required. Since the transfer of energy is carried out under the vibration coupling made through the coupling unit, the excitation based on the carrier wave places a limitation on the transfer of the energy to the pipe.

(6) In a signal transmission system based on the repeat rate, it is necessary to repeatedly generate a burst signal in order to make a decision as to the repeat rate. The minimum time required to generate and transfer information per bit is restricted, so that an increase in bit rate becomes hard.

SUMMARY OF THE INVENTION

With the foregoing in view, it is one object of the present invention to provide a system for transmitting a signal, wherein a large exciting acceleration can be obtained with a small exciting amplitude and hence the maintenance is easy and signal transmission can be reliably effected even when a long drill string is used.

It is another object of the present invention to provide a system for transmitting a signal, wherein since the system can modulate the signal without using a carrier wave, provide a high exciting force and reduce the power per bit, it is suitable for use in an MWD transmission system in which a limitation is imposed on securable power capacity, and can effect a signal transmission at a high bit rate.

It is a further object of the present invention to provide a system for transmitting a signal, wherein an eddy current loss produced by a high impulse current can be reduced and a high output can be transmitted.

It is a still further object of the present invention to provide a system for transmitting a signal, wherein since an output to be transmitted is high and the efficiency of transmission of the signal is high, the system can be reduced in size.

It is a still further object of the present invention to provide a system for transmitting a signal, wherein the system is simple in structure and the mountability of the system is high.

It is a still further object of the present invention to provide a system for transmitting a signal, wherein an exciting force can be efficiently transferred to an acoustic wave transmission medium.

It is a still further object of the present invention to provide a system for transmitting a signal, wherein a large exciting force can be transmitted.

It is a still further object of the present invention to provide a system for transmitting a signal, wherein the system is simple in structure and low in cost.

It is a still further object of the present invention to provide a system for transmitting a signal, wherein transmitted acoustic waves are not superposed on one another and prevented from interfering with each other.

It is a still further object of the present invention to provide a system for transmitting a signal, wherein a large exciting output can be obtained.

It is a still further object of the present invention to provide a system for transmitting a signal, wherein signal transmission can be effected at a satisfactory S/N ratio.

It is a still further object of the present invention to provide a system for transmitting a signal, wherein the signal can be received with high sensitivity.

It is a still further object of the present invention to provide a method of transmitting a signal, wherein a large exciting acceleration can be obtained with a small exciting amplitude and hence maintenance is easy and signal transmission can be reliably effected even when a long drill string is used.

It is a still further object of the present invention to provide a method of transmitting a signal, wherein since a signal modulating process can be effected without using a carrier wave, a high exciting force can be created and the power per bit can be reduced, the method is suitable for use in an MWD transmission system in which a limitation is imposed on securable power capacity and signal transmission can be effected at a high bit rate.

According to a first aspect of this invention, for achieving the above objects, there is provided a system for transmitting a signal, wherein a signal transmission is effected by transmitting the signal sound to a rodlike body using a magnetostrictive phenomenon and receiving the signal sound by an acoustic wave receiver.

As described above, the system according to the first aspect of this invention is constructed in such a manner that an ultrasonic wave is produced by the magnetostrictive phenomenon and propagated through the rodlike body. Since the magnetostrictive phenomenon can obtain an acceleration which is low in amplitude and large, maintenance is easy. Further, since the ultrasonic wave is an acoustic wave, the attenuation thereof is low as compared with the use of a radio wave. Even when a long drill string is used, a signal transmission can be reliably effected. Furthermore, since a magnetostrictive element is constructed by winding excitation windings around a magnetostrictive material, an interlinkage relationship exists between the magnetostrictive material and the excitation windings and they are dynamically independent of each other. It is therefore possible to avoid the drawback of a piezoelectric element employed in the conventional signal transmission system using the acoustic wave, that since the direction of distortion of the piezoelectric element coincides with an electric-field applying direction, the stress is applied to electrodes themselves and a pre-load required to transmit the acoustic wave to a tubular body or pipe cannot be sufficiently applied thereto.

According to a second aspect of this invention, there is provided a system for transmitting a signal, wherein an exciting current, which flows at a speed at which the magnetostrictive material is distorted or at a rise speed substantially identical to the speed, is supplied to the excitation windings.

In the system according to the second aspect of this invention as described above, a magnetostrictive phenomenon achieved at a high speed is produced. Hence an avalanche phenomenon peculiar to the magnetostrictive phenomenon is induced in response to its generation and an impulsive force produced according to an acceleration at the time of the occurrence of sharp magnetostriction is transferred to a rodlike body. Thus, an electrical and mechanical acoustic coupling, which is efficient at an impact reaction region peculiar to the magnetostrictive material, can be realized so that the impulsive force can be converted into a large ultrasonic energy that cannot be obtained by excitation coupling using a carrier wave of a specific frequency. Further, since one bit can be assigned to one impactive ultrasonic signal, the minimum time required to represent information per bit can be compressed and hence a signal transmission can be effected at a high bit rate.

According to a third aspect of this invention, there is provided a system for transmitting a signal, wherein a plurality of thin plate-like magnetostrictive materials are stacked on one another so as to form a magnetostrictive element.

In the system according to the third aspect of this invention as described above, since the plurality of thin plate-like magnetostrictive materials are stacked on one another, an eddy-current loss of each magnetostrictive material, which is produced according to a variation in drive current flowing in the magnetostrictive element, is reduced and magnetostriction is produced up to the inside of the magnetostrictive element, thereby making it possible to obtain an output corresponding to several times the output of the magnetostrictive element comprised of a piece of magnetostrictive material.

According to a fourth aspect of this invention, there is provided a system for transmitting a signal, wherein excitation windings for a magnetostrictive element are constructed so as to form a return circuit arrangement.

In the system according to the fourth aspect of this invention as described above, since a magnetic circuit is constructed in the return arrangement, magnetic fluxes produced by exciting windings flow in the same direction so that a large output with reduced loss in the magnetic circuit can be obtained.

According to a fifth aspect of this invention, there is provided a system for transmitting a signal, wherein a magnetostrictive element is constructed in such a manner that a closed-loop magnetic field is developed in a magnetostrictive material of a core-type transformer structure.

In the system according to the fifth aspect this invention as described above, since the magnetostrictive material has the rectangular-shaped core-type transformer structure, the magnetostrictive element is simple in structure and can be disposed even in a position such as the central position or the like of a rodlike body where a stacked magnetostrictive element is difficult to locate, thus enhancing mountability.

According to a sixth aspect of this invention, there is provided a system for transmitting a signal, wherein an acoustic horn is mounted to a leading end portion of a magnetostrictive element.

In the system according to the sixth aspect of this invention as described above, since the acoustic horn is provided, the energy is concentrated by the acoustic horn and the density of energy of an ultrasonic wave is amplified and the energy whose density has been amplified is injected into a rodlike body. Thus, the energy is effectively transmitted at a transmission level of a crystal lattice energy, thereby making it possible to efficiently transfer an exciting force to the rodlike body.

According to a seventh aspect of this invention, there is provided a system for transmitting a signal, wherein a leading end portion of an acoustic horn attached to a magnetostrictive element is pressed against a rodlike body under a suitable pressure.

In the system according to the seventh aspect of this invention as described above, since the leading end portion of the acoustic horn is pressed against the rodlike body under the suitable pressure (pre-load), no space is defined between the leading end portion of the acoustic horn and the rodlike body and magnetostriction developed in the magnetostrictive element can be efficiently transferred to the rodlike body. Further, there is no risk of breakage of the leading end portion under an exciting force produced by the magnetostriction.

According to an eighth aspect of this invention, there is provided a system for transmitting a signal, wherein mutually-synchronized exciting currents are supplied to excitation windings wound around a plurality of magnetostrictive elements.

In the system according to the eighth aspect of this invention as described above, since the plurality of magnetostrictive elements are distorted in unison with each other, individual exciting forces are added together so that a large exciting force can be obtained as a whole.

According to a ninth aspect of this invention, there is provided a system for transmitting a signal, wherein one resistor is provided which is series-connected to the excitation windings wound around a plurality of magnetostrictive elements.

In the system according to the ninth aspect of this invention as described above, since the single resistor common to the respective excitation windings is provided, the number of parts is reduced to thereby decrease the manufacturing cost and the capacity for mounting the parts can be diminished, thereby making it possible to reduce the shape of the entire system.

According to a tenth aspect of this invention, there is provided a system for transmitting a signal, wherein an exciting impulse current is produced at time intervals during which impact waves propagated through a rodlike body are not superposed on one another.

In the system according to the tenth aspect of this invention as described above, since the exciting impulse current flows at the time intervals during which the impact waves are not superposed on one another, there is no interference between acoustic signals and a highly reliable signal transmission can be effected.

According to an eleventh aspect of this invention, there is provided a system for transmitting a signal, wherein a plurality of impulse currents are supplied to magnetostrictive elements such that the peaks of an impact wave propagated through a rodlike body are in phase with each other and superposed on one another.

In the system according to the eleventh aspect of this invention as described above, since the plurality of impulse currents flow in the magnetostrictive elements such that the peaks of the impact wave are in phase and superposed on one another, the peaks of the impact wave produced by the respective impulse currents are superposed on one another so that an impact wave large in amplitude as a whole can be obtained.

According to a twelfth aspect of this invention, there is provided a system for transmitting a signal, wherein a detector circuit for suppressing small signal components and enhancing effective signal components is incorporated in a acoustic wave receiver.

In the system according to the twelfth aspect of this invention as described above, noise components are removed by a filter and the detector circuit and signal components are enhanced by the detector circuit. Thus, the S/N ratio is improved.

According to a thirteenth aspect of this invention, there is provided a system for transmitting a signal, comprising period detecting means for detecting a signal transmitting period on the transmission side and sampling means for sampling a signal to be transmitted, in synchronism with the detected transmitting period.

In the system according to the thirteenth aspect of this invention as described above, since the signal transmitting period on the transmission side is detected and the signal to be transmitted is sampled in synchronism with the detected period, the signal can be reliably received and a stable demodulating process capable of providing a high S/N ratio can be effected.

According to a fourteenth aspect of this invention, there is provided a system for transmitting a signal, comprising noise-component calculating means for calculating noise components produced due to the reflection and resonance of a signal sound propagated through a rodlike body and noise-component removing means for removing the noise components calculated by the noise-component calculating means from signal components.

In the system according to the fourteenth aspect of this invention as described above, since the noise components are detected and the signal components are processed so as to exclude an influence of the noise components, which is exerted on the signal components, a demodulating process capable of providing a satisfactory S/N ratio can be performed.

According to a fifteenth aspect of this invention, there is provided a system for transmitting a signal, comprising storing means for storing therein in advance a pattern of noise components produced due to the reflection and resonance of a signal sound propagated through a rodlike body and noise-component removing means for removing the noise components stored in the storing means from signal components.

In the system according to the fifteenth aspect of this invention as described above, since the pre-stored pattern of the noise components produced due to the reflection and resonance of the signal sound propagated through the rodlike body is removed from the signal components, a demodulating process capable of providing a satisfactory S/N ratio can be effected.

According to a sixteenth aspect of this invention, there is provided a system for transmitting a signal, wherein an electro-acoustic transducer for converting an acoustic signal propagated through a rodlike body into an electric signal is provided in plural form.

In the system according to the sixteenth aspect of this invention as described above, since each of acoustic signals received by the plurality of electro-acoustic transducers is converted into the electric signal, signal components can be reliably received and a stable demodulating process capable of providing a satisfactory S/N ratio can be effected.

According to a seventeenth aspect of this invention, there is provided a system for transmitting a signal, wherein at least one magnetostrictive element is provided as an electro-acoustic transducer for converting an acoustic signal propagated through a rodlike body into an electric signal.

In the system according to the seventeenth aspect of this invention as described above, since the acoustic signal is received by the magnetostrictive element and the received acoustic signal is converted into an electric signal, the acoustic signal can be detected in a state in which an acoustic impedance at a receiver portion has been minimized and hence a highly sensitive reception can be performed. Further, since the magnetostrictive element is high in Curie temperature, a receiving system operable even under a high-temperature environment can be constructed. Furthermore, when the sharing between a transmitter and a receiver can be made and they are used as a bidirectional signal transmission system, a compact and efficient signal transmission system can be constructed.

According to an eighteenth aspect of this invention, there is provided a system for transmitting a signal, comprising at least one acoustic horn for amplifying an acoustic signal propagated through a rodlike body and an electro-acoustic transducer for converting the acoustic signal amplified by the acoustic horn into an electric signal.

In the system according to the eighteenth aspect of this invention as described above, since the sound signals propagated through the rodlike body from the acoustic horns are collected and received, even a weak acoustic wave can be received.

According to a nineteenth aspect of this invention, there is provided a system for transmitting a signal, wherein an acoustic wave receiver is provided with a power supply comprised of complex batteries for outputting a plurality of power supply voltages.

In the system according to the nineteenth aspect of this invention as described above, since the plurality of power supply voltages are supplied from the complex batteries, a converter becomes unnecessary, noise such as switching noise, etc. is not produced and the loss is reduced.

According to a twentieth aspect of this invention, there is provided a method of transmitting a signal, wherein a signal transmission is effected by generating a signal sound under a magnetostrictive phenomenon, propagating the signal sound through a rodlike body and receiving the signal sound by an acoustic wave receiver situated in a predetermined position of the rodlike body.

In the method according to the twentieth aspect of this invention as described above, since the signal transmission is effected such that the signal sound generated by the magnetostrictive phenomenon is propagated through the rodlike body and received by the acoustic wave receiver, the maintenance is simple and the signal transmission can be reliably performed even when a long drill string is used. Further, a pre-load required to transmit the acoustic wave to a tubular body or pipe can be sufficiently applied thereto.

According to a twenty-first aspect of this invention, there is provided a method of transmitting a signal, wherein a magnetostrictive phenomenon is abruptly generated or abruptly vanished and an impulsive force produced according to an acceleration associated with magnetostriction at the time of the abrupt occurrence or vanishment of the magnetostrictive phenomenon is propagated through a rodlike body as an acoustic signal.

In the method according to the twenty-first aspect of this invention as described above, since a signal transmission is performed such that the impulsive force produced according to the acceleration at the time of the abrupt occurrence or vanishment of the magnetostrictive phenomenon is transferred to the rodlike body, an efficient electrical and mechanical acoustic coupling can be realized so that the impulsive force can be converted into a large ultrasonic energy. Further, the minimum time required to represent information per bit can be compressed and the transmission of the signal at a high bit rate can be effected.

According to a twenty-second aspect of this invention, there is provided a method of transmitting a signal, wherein the impulsive force is applied to the rodlike body plural times such that the peaks of an impact wave propagated through the rodlike body are in phase and superposed on one another.

In the method according to the twenty-second aspect of this invention as described above, since the impact wave is applied to the rodlike body such that the peaks of the impact wave are in phase and superposed on one another, an impact wave large in amplitude as a whole can be obtained.

According to a twenty-third aspect of this invention, there is provided a method of transmitting a signal, wherein noise components produced due to the reflection and resonance of a signal sound propagated through a rodlike body are calculated and the calculated noise components are removed from an electric signal converted from the acoustic signal.

In the method according to the twenty-third aspect of this invention as described above, since the noise components are calculated and the so-calculated noise components are removed from the signal components, a demodulating process capable of providing a satisfactory S/N ratio can be effected.

According to a twenty-fourth aspect of this invention, there is provided a method of transmitting a signal, wherein noise components produced due to the reflection and resonance of the signal sound propagated through a rodlike body are removed out of an electric signal converted from an acoustic signal, based on a pre-stored pattern of noise components.

In the method according to the twenty-fourth aspect of this invention as described above, since the noise components are removed from the signal components based on the pre-stored pattern of noise components, a demodulating process capable of providing a satisfactory S/N ratio can be effected.

According to a twenty-fifth aspect of this invention, there is provided a method of transmitting a signal, wherein an acoustic signal propagated through a rodlike body is converted into an electric signal by each of a plurality of electro-acoustic transducers.

In the method according to the twenty-fifth aspect of this invention, since the acoustic signal is converted into the electric signal by each of the plurality of electro-acoustic transducers, signal components can be reliably received and a stable demodulating process capable of providing a satisfactory S/N ratio can be effected.

The above and other objects, novel features and advantages of the present invention will become more apparent from the following detailed description, referring to the accompanying drawings. However, the drawings are used only for explanation and do not limit the scope of this invention.

BRIEF DESCRIPTION OF THE DRAWINGS

FIGS. 7(1) and 7(2) are respectively waveform charts for describing waveforms of signals employed in the signal transmission system shown in FIG. 5;

FIGS. 8(1) and 8(2) are respectively waveform charts for describing waveforms of signals employed in the signal transmission system shown in FIG. 5;

FIGS. 17(1) and 17(2) are respectively perspective views showing the magnetostrictive material employed in the signal transmission system shown in FIG. 9;

DETAILED DESCRIPTION OF THE PREFERRED EMBODIMENTS

A preferred embodiment of the present invention will now be described in detail with reference to the accompanying drawings.

Figure 9:
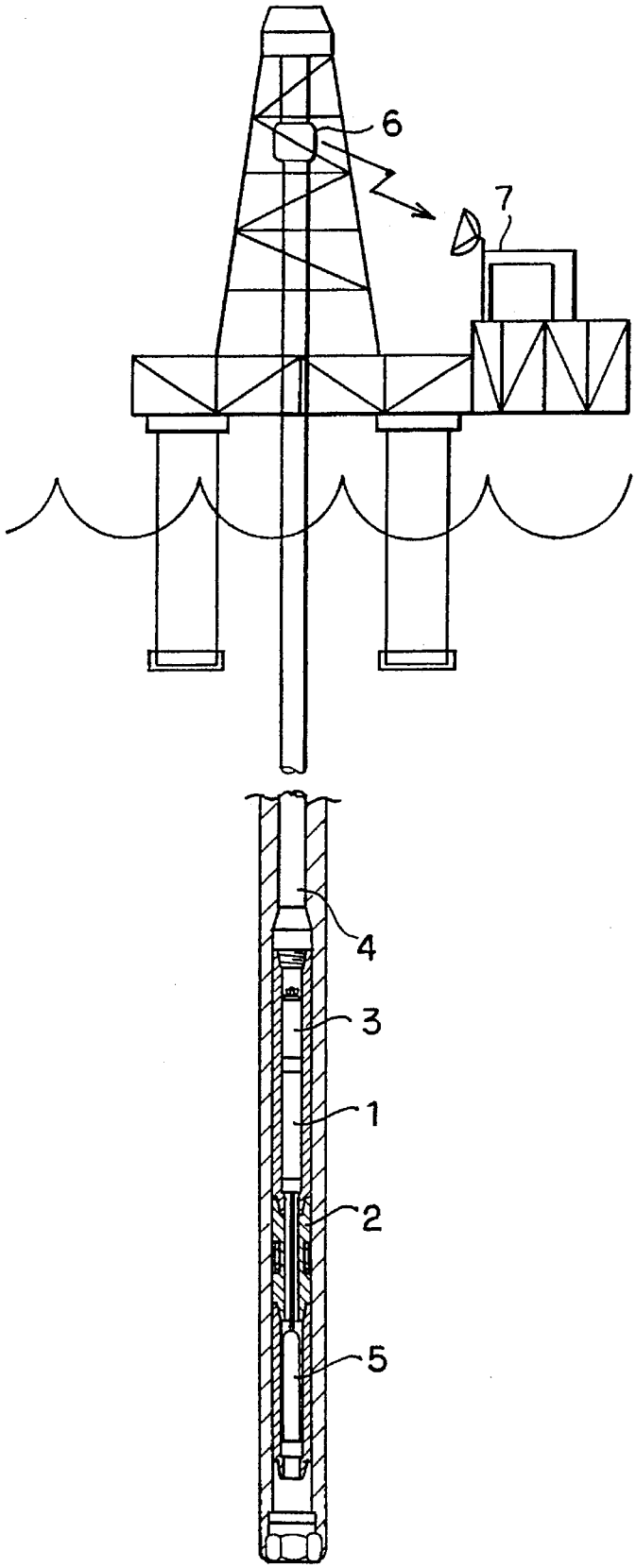
FIG. 9 is a side view showing a signal transmission system according to one embodiment of the present invention.

FIG. 9 is a general view showing the overall structure of one embodiment. In FIG. 9, reference numerals 1, 2, 3, 4, 5, 6 and 7 respectively indicate a transmitter sub having a transmitter accommodated therein, an oscillator sub having a signal generator held therein, a mud turbine generator, a drill pipe, a detector at bottom of hole, a receiver sub having a receiver accommodated therein, and a logging station installed in the ground, for recording and storing data therein.

Figure 10:
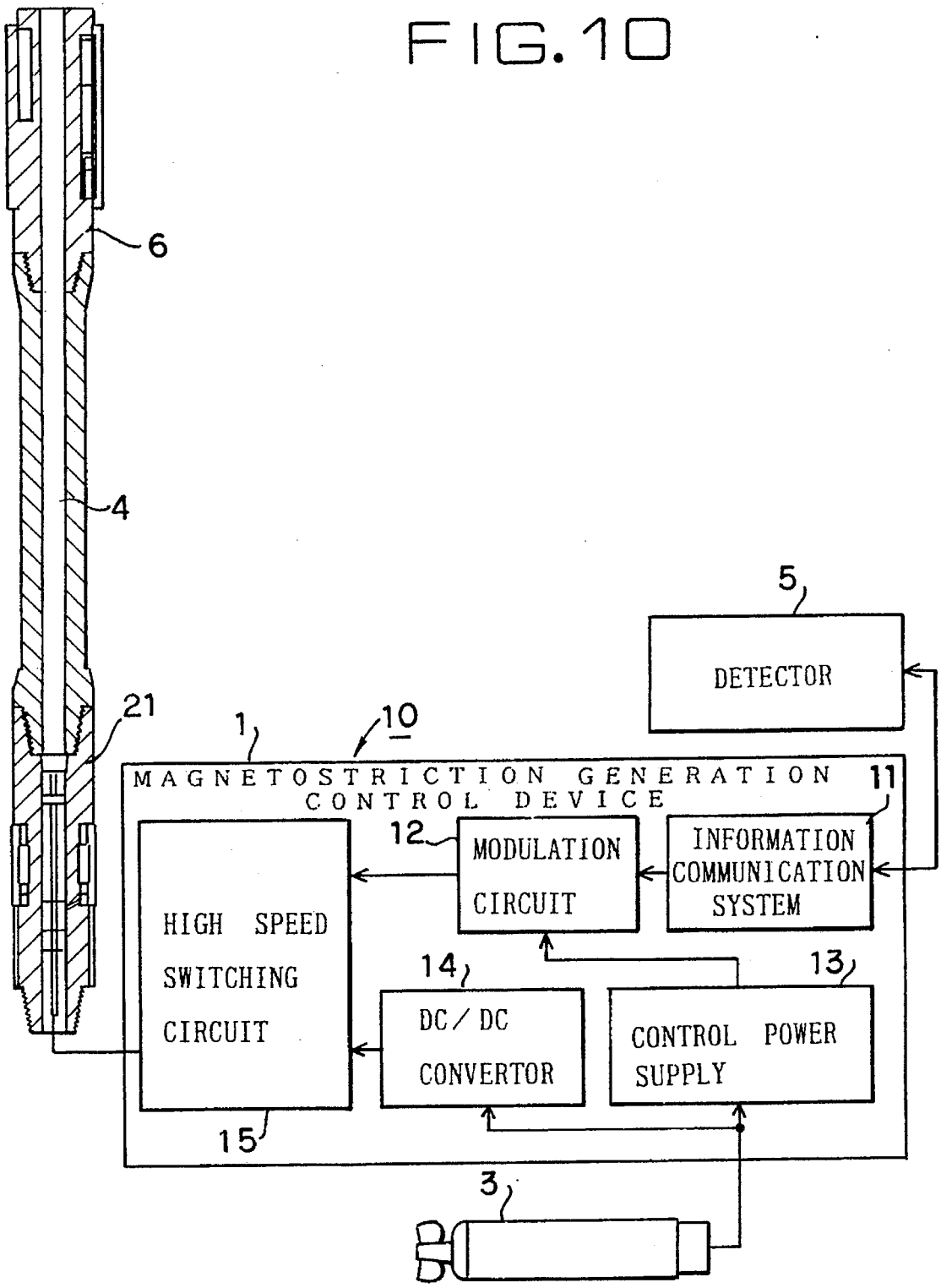
FIG. 10 is a view illustrating a magnetostriction generation control device employed in the signal transmission system shown in FIG. 9.
Figure 13:
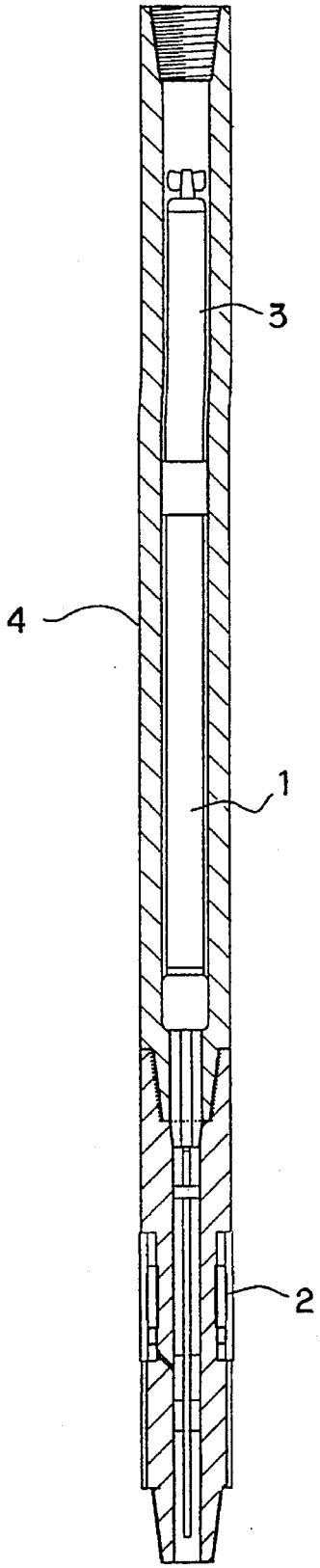
FIG. 13 is a view for describing a spatial layout of a transmitter sub employed in the signal transmission system shown in FIG. 9.
Figure 14:
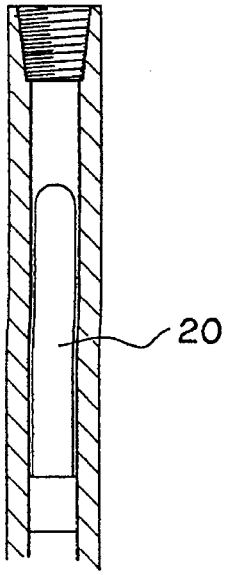
FIG. 14 is a view for describing a spatial layout of a battery employed in the signal transmission system shown in FIG. 9.

FIG. 10 is a view illustrating a principal circuit configuration of the transmitter sub 1 employed in the present embodiment (incidentally, a spatial layout of this section is shown in FIG. 13). In FIG. 10, reference numeral 11 indicates an information communication system for effecting the transmission of information between the information communication system and the detector 5. Reference numeral 12 indicates a modulation circuit for impact-modulating data detected by the detector 5 to a signal to be transmitted from a bottom of hole to the ground. Reference numeral 13 indicates a control power supply for supplying power to the modulation circuit 12 and other electric circuits in the form of a constant voltage. Reference numeral 14 indicates a constant-voltage DC/DC converter for supplying a high current to an oscillator or an oscillating device. Reference numeral 15 indicates a high-speed switching circuit (exciting impulse current generating circuit) for providing an impact current. The information communication system 11, the modulation circuit 12, the control power supply 13, the constant-voltage DC/DC converter 14 and the high-speed switching circuit 15 form a magnetostriction generation control device 10 and are incorporated in the transmitter sub 1. Incidentally, in the impact modulation, one-bit information is modulated using typically a single impact impulse. For example, modulated bit "1" corresponds to a modulated signal under the application of the impact impulse and modulated bit "0" correspond to a modulated signal without applying the impact impulse. The impact modulation can bring about an effect that the energy can be effectively transmitted to the drill pipe 4 corresponding to a transmission medium as compared with a modulation using a carrier wave. However, the one-bit information may also be modulated based on a plurality of impact impulses.

Reference numeral 21 indicates a magnetostriction oscillating element (oscillator) which is mounted in the vibrator sub 2.

Figure 11:
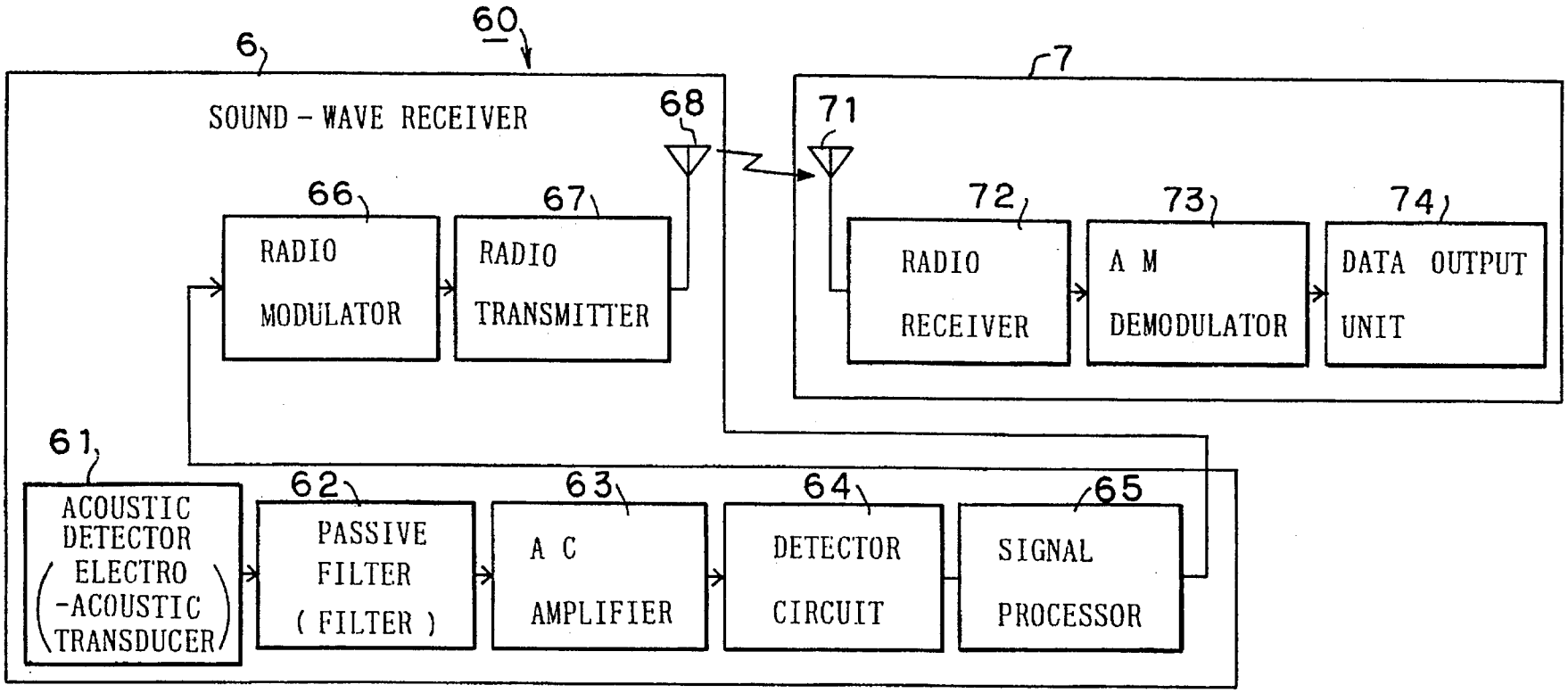
FIG. 11 is a block diagram showing the configuration of an acoustic wave receiver of the magnetostriction generation control device employed in the signal transmission system shown in FIG. 9.

FIG. 11 is a block diagram showing the structure of an acoustic wave receiver 60 and the logging station 7 both incorporated in the receiver sub 6. In the same drawing, reference numeral 61 indicates an acoustic detector (electro-acoustic transducer) for detecting an acoustic signal propagated through a drill string. Reference numeral 62 indicates a passive filter having a high-frequency pass characteristic, for removing low-frequency noise. Reference numeral 63 indicates a high-gain ac amplifier. Reference numeral 64 indicates a detector circuit having a square-law detector, an envelope detecting circuit or the like. Reference numeral 65 indicates a signal processor for performing A/D conversion on input data, performing D/A conversion on the data after processing of the various data and outputting the processed data therefrom. Reference numeral 66 indicates a radio-transmission modulator for modulating the amplitude of an input signal. Reference numeral 67 indicates a radio transmitter for transmitting an input signal in the form of a radio frequency. Designated at numeral 68 is a transmitting antenna.

Designated at numeral 71 is a receiving antenna. Reference numeral 72 indicates a radio receiver and reference numeral 73 indicates an AM demodulator circuit. Designated at numeral 74 is a data output unit for filing, displaying and printing out transmitted bottom-hole data or outputting information to be supplied to the outside to a communication line.

The operation of the present embodiment will now be described below. The present embodiment is suitable for the purpose of making an improvement in efficiency and safety of drilling such as crude petroleum well drilling, gas well drilling or the like and of reducing drilling costs using an MWD for propagating an acoustic signal through the drill string connected with the drill pipe 4 and transmitting information about the strata of a bottom of hole, the condition of drilling, bearings, etc. to the ground.

In the bottom of hole, various detectors 5 are disposed in the vicinity of a drill bit. Further, the information communication system 11 in the transmitter sub 1 takes in the various information detected by the detectors 5 and the modulation circuit 12 effects the impact modulation on the taken-in information. That is, a current, whose rising speed is identical to a response speed of a magnetostrictive material of the magnetostriction vibrator 21, is supplied to excitation windings of the magnetostriction vibrator 21 through the high-speed switching circuit 15. When a magnetic field reaches an intended value, the current is cut off from flowing. In doing so, the magnetostrictive material expands and contracts in accordance with its material characteristic and a powerful acceleration is developed based on its expansion and contraction characteristic to thereby produce an impulse wave. The produced wave is brought to an acoustic signal, which propagates through the drill string so as to reach the receiver sub 6 provided on the ground.

In the receiver sub 6, the acoustic detector 6 detects a signal propagated through the drill string. The passive filter 62 removes low-frequency noise from the signal. Further, the high-gain ac amplifier 63 amplifies the signal from the passive filter 62 and the detector circuit 64 effects a detection process on the amplified signal so as to remove noise. Thereafter, the signal processor 65 demodulates the noise-removed signal to the original coded data signal. Since the top portion of the drill string is normally formed as a rotatable structure, the signal cannot be directly taken out by wire. Thus, the modulator 66 modulates a radio carrier wave based on data inputted from the signal processor 65 and the radio transmitter 67 transmits the modulated output to the logging station 7 through the transmitting antenna 68 as a radio wave. The logging station 7 receives the radio wave through the receiving antenna 71 and the radio receiver 71. Thereafter, the demodulator circuit 73 demodulates the received radio wave so as to return it to the original data. Under the operation of the data output unit 74, the demodulated data are stored in a disc, printed out under either time information or progress-of-drilling information and displayed on a display. Further, the data output unit 74 effects information communications with a system for analyzing other drilling and strata.

Figure 12:
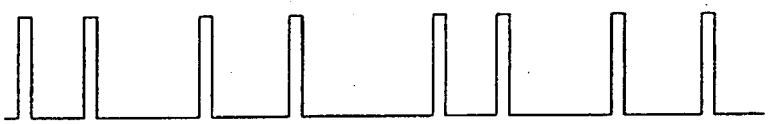
FIGS. 12(1) and 12(2) are respectively waveform charts for describing one example of an operated waveform used for the signal transmission system shown in FIG. 9.
Figure 12:
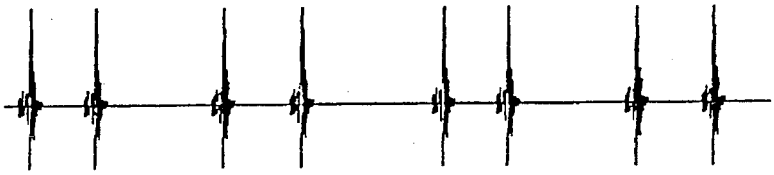

The high-speed switching circuit 15 supplies an impulse current having a waveform including two short pulses shown in FIG. 12(1) to the magnetostriction vibrator 21. Thus, such a sharp impulse wave as shown in FIG. 12(2) is produced and propagated through the drill string. Since the width of a principal component of the impact wave is extremely short, the impact wave is transmitted at a rate several tens times the conventional transfer rate of a mud pulse.

Figure 18:
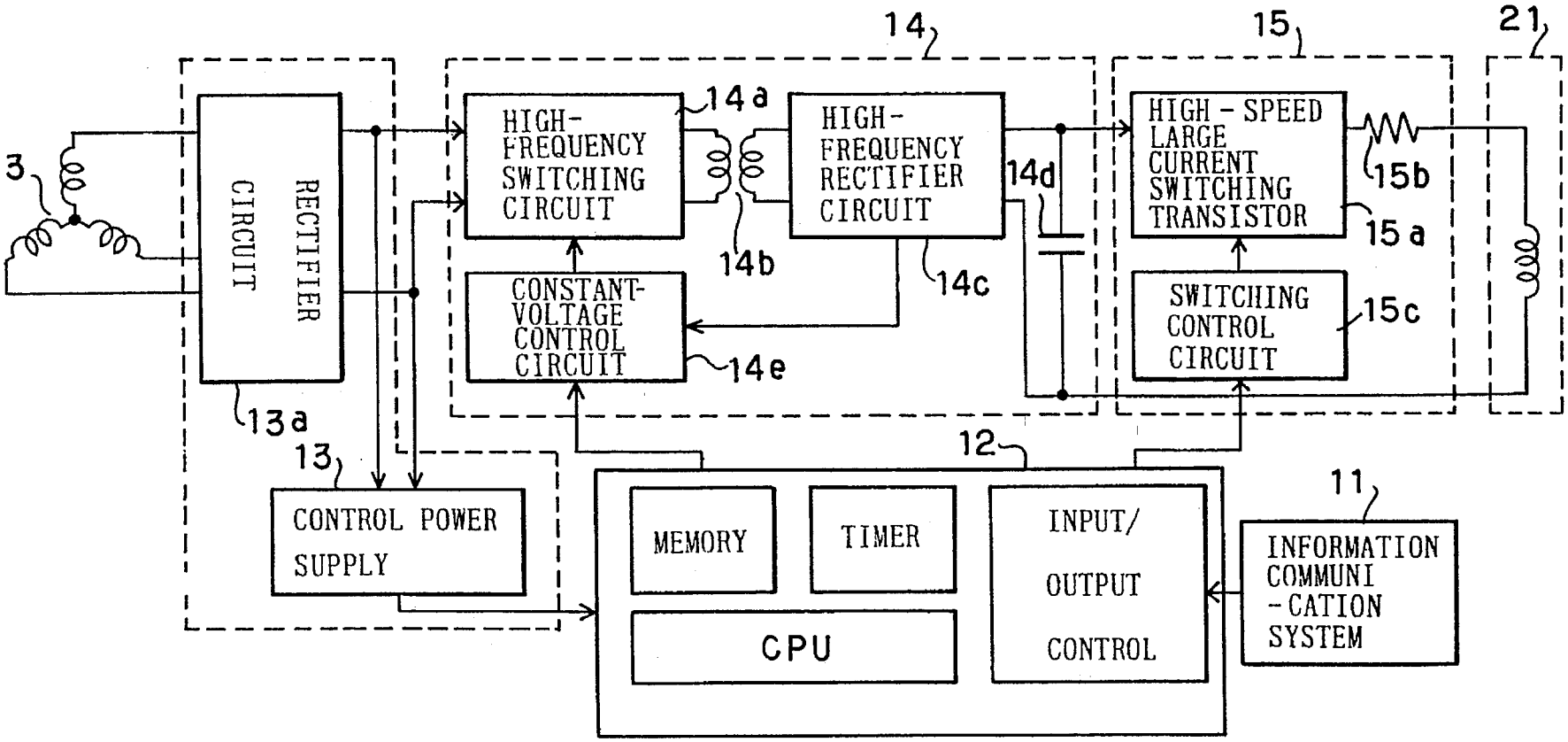
FIG. 18 is a block diagram illustrating a circuit configuration of the magnetostriction generation control device employed in the signal transmission system shown in FIG. 9.

FIG. 18 is a block diagram showing a specific circuit configuration of the magnetostriction generation control device 10. In FIG. 18, reference numeral 13*a* indicates a rectifier circuit for rectifying a voltage outputted from the mud turbine generator 3. Reference numeral 14*a* indicates a high-frequency switching circuit for switching the d.c. voltage rectified by the rectifier circuit 13*a* with a high frequency. Reference numeral 14*b* indicates a high-frequency transformer. Reference numeral 14*c* indicates a high-frequency rectifier circuit for rectifying an output voltage on the secondary side of the high-frequency transformer 14*b*. Reference numeral 14*d* indicates a waveform-smoothing capacitor. Reference numeral 14*e* indicates a constant-voltage control circuit for controlling a voltage outputted from the high-frequency rectifier circuit 14*c*. Reference numeral 15*a* indicates a high-speed large current switching transistor. Reference numeral 15*b* indicates an externally-provided resistor. Designated at numeral 15*c* is a switching control circuit for controlling a switching time of the transistor 15*a*. In all the embodiment subsequent to the present embodiment inclusive of the present embodiment, the same elements of structure as those described before the subsequent embodiments are identified by like reference numerals and their description will therefore be omitted.

Figure 1:
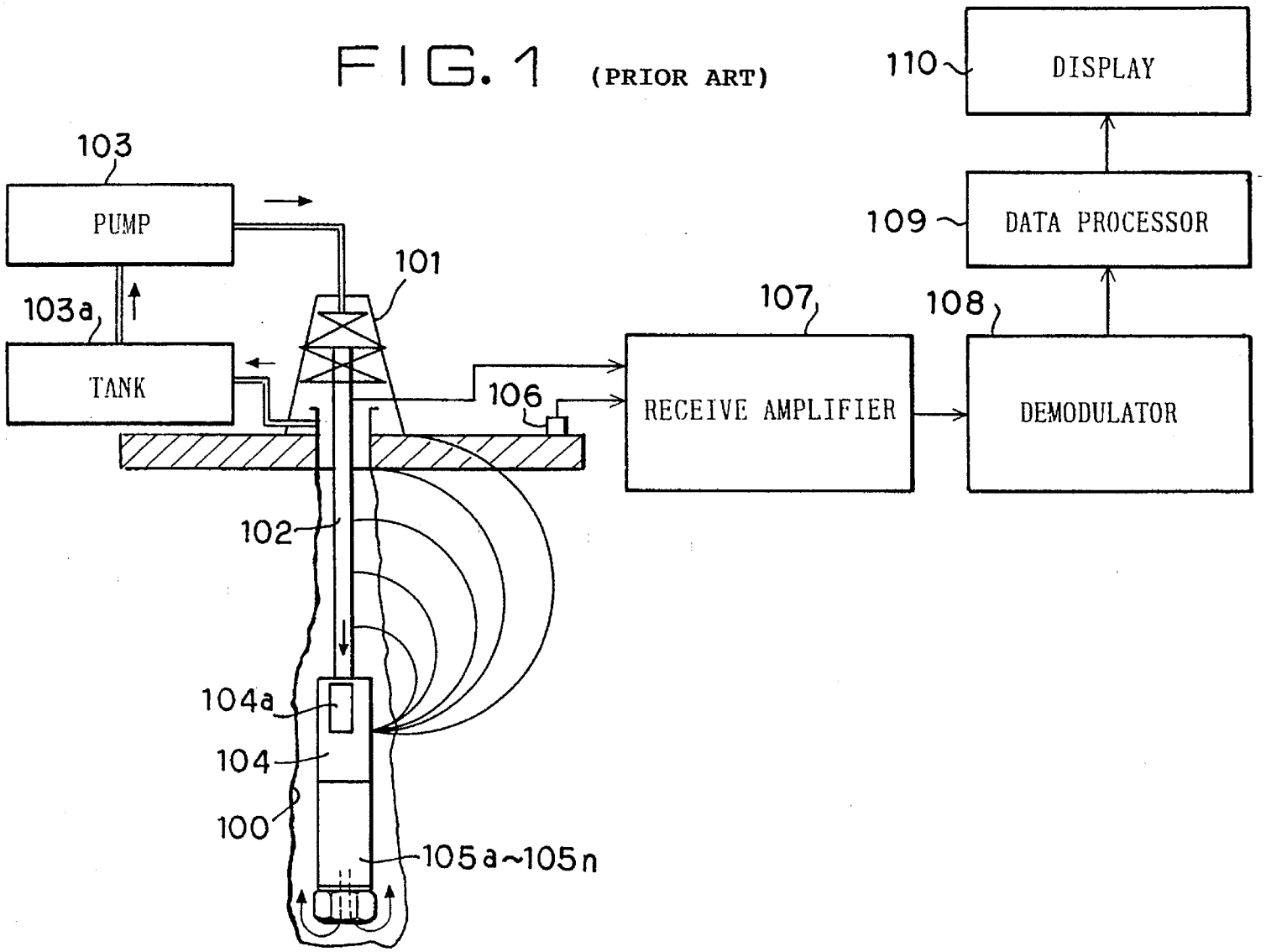
FIG. 1 (PRIOR ART)
FIG. 1 is a view illustrating a typical structure of a conventional signal transmission system.
Figure 2:
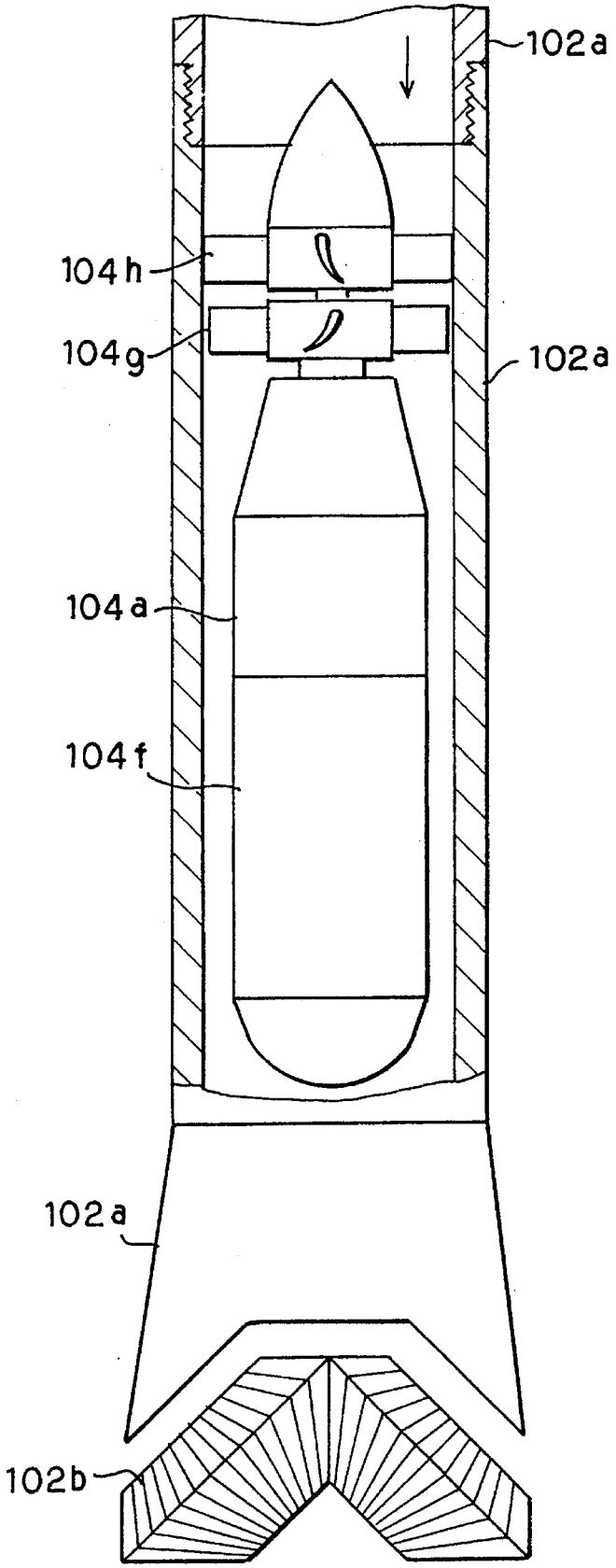
FIG. 2 (PRIOR ART)
FIG. 2 is a cross-sectional view showing a signal generator unit of the signal transmission system shown in FIG. 1.
Figure 3:
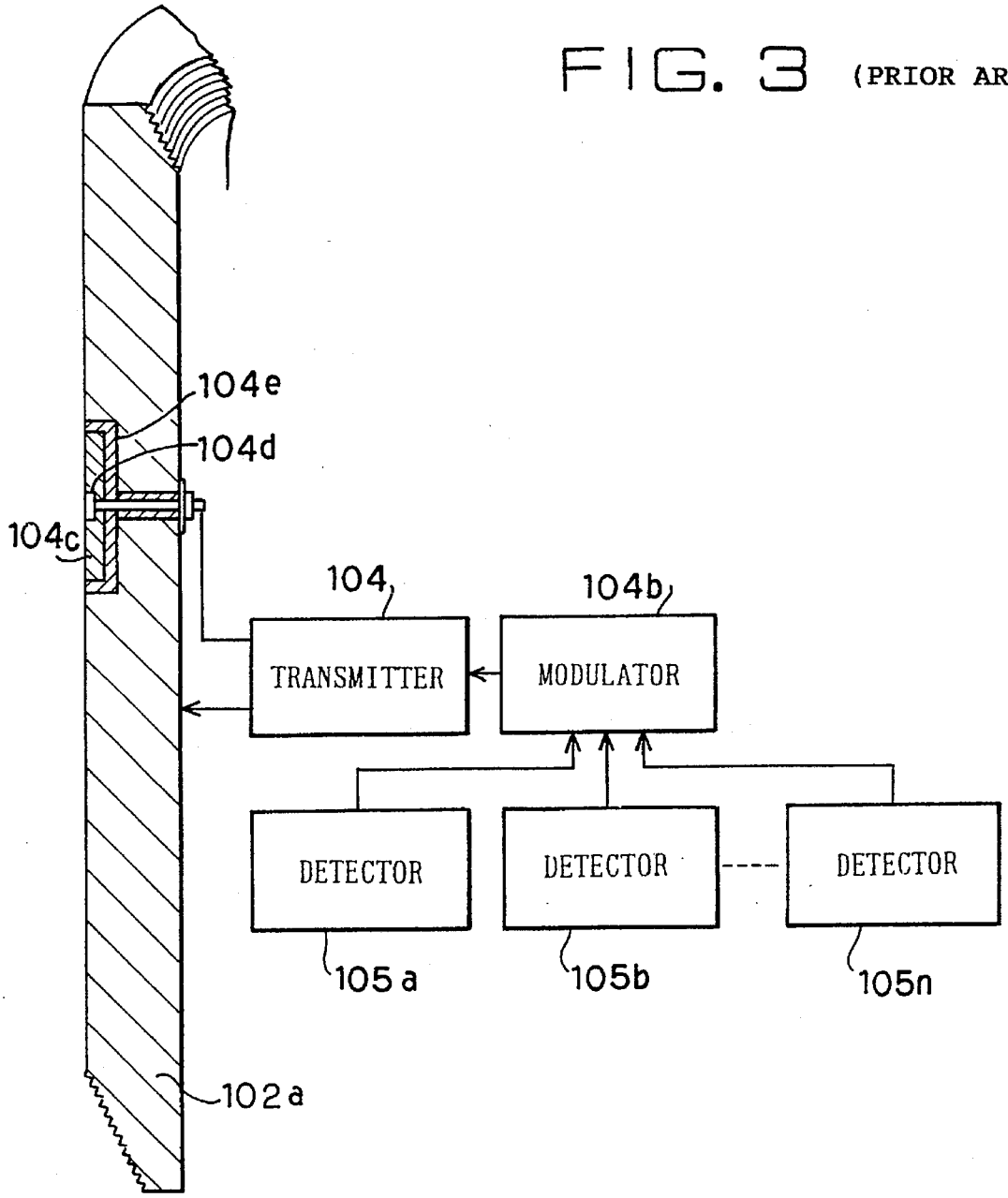
FIG. 3 (PRIOR ART)
FIG. 3 is a view illustrating the signal generator unit of the signal transmission system shown in FIG. 1.
Figure 4:
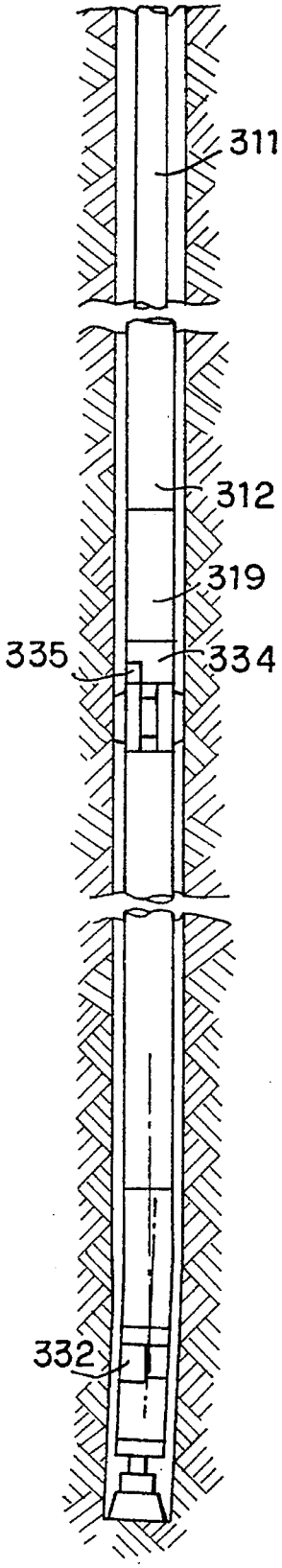
FIG. 4 (PRIOR ART)
FIG. 4 is a side view showing one example of the conventional signal transmission system disposed in the ground.
Figure 5:
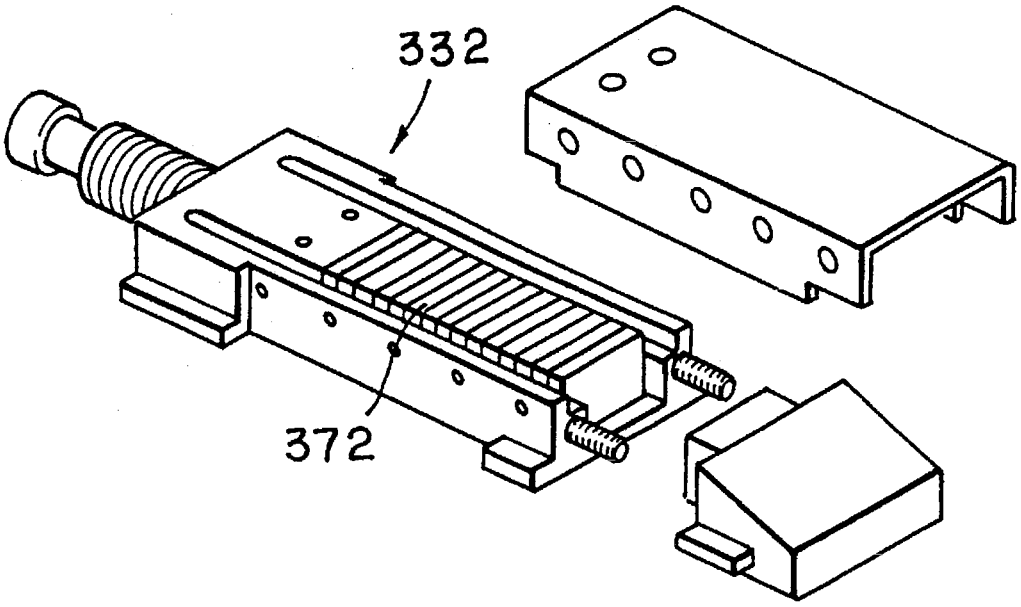
FIG. 5 (PRIOR ART)
FIG. 5 is a perspective view depicting the structure of a magnetostriction oscillating device of the signal transmission system shown in FIG. 4.
Figure 6:
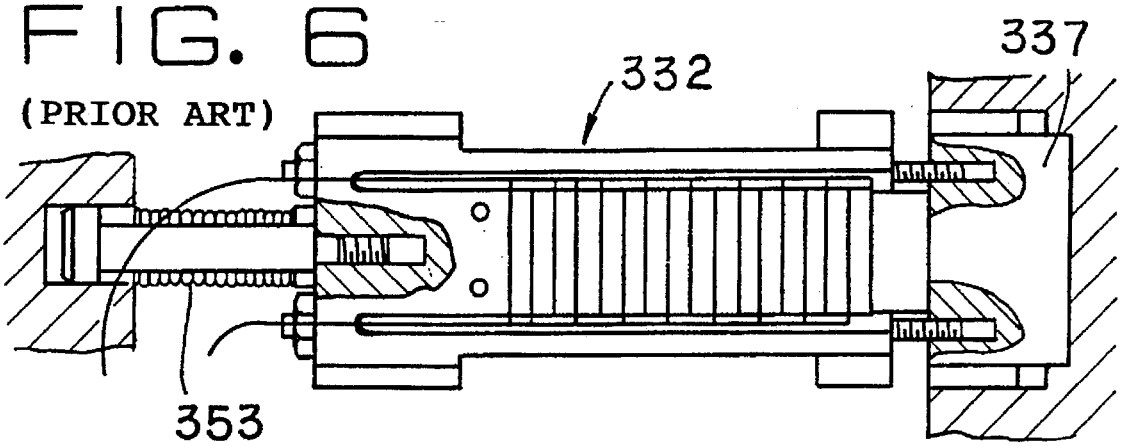
FIG. 6 (PRIOR ART)
FIG. 6 is a side view showing the magnetostriction oscillating device shown in FIG. 5.

The operation of the magnetostriction generation control device 10 will now be described below. A three-phase ac current produced by the mud turbine generator 3 is rectified by the rectifier circuit 13*a* from which the rectified voltage is supplied to the constant-voltage DC/DC converter 14. The high-frequency switching circuit 14*a* in the constant-voltage DC/DC converter 14 switches the rectified voltage and the switched voltage is boosted by the high-frequency transformer 14*b*. Thereafter, the boosted voltage is stored in the capacitor 14*d* through the high-frequency rectifier circuit 14*c*. The switching action of the constant-voltage DC/DC converter 14 is controlled in accordance with a pulse-width modulation system, for example, and subjected to constant-value control on a fixed voltage basis to stably supply a constant voltage to the magnetostriction vibrator 21. The constant-voltage control circuit 14*e* can change a voltage level outputted from the high-frequency rectifier circuit 14*c* to a value set as needed in response to a command or instruction issued from the modulation circuit 12. On the other hand, the voltage rectified by the rectifier circuit 13*a* is also supplied to the control power supply 13 from which a necessary d.c. power supply voltage is supplied to a control circuit such as the modulation circuit 12 or the like. The mud turbine generator 3 may be such a battery 20 as shown in FIG. 6. In this case, the constant-voltage output of the battery 20 is directly supplied to the constant-voltage DC/DC converter 14.

The high-speed switching circuit 15 serves as a driver for supplying the electric charge stored in the capacitor 14*d* to the magnetostriction oscillating element 21 via the series resistor 15*b*. Further, the high-speed switching circuit 15 is driven by the high-speed switching transistor 15*a* capable of providing a large current flow. The switching control circuit 15*c* serves as a circuit for controlling the gate of the high-speed switching transistor 15*a* and activates the high-speed switching transistor 15*a* with timing outputted from a pulse generating circuit in the modulation circuit 12. Further, the switching control circuit 15*c* rapidly switches the electric charge stored in the capacitor 14*d* to produce an impact current. The impact current corresponds to a current pulse whose rise is sharp and having a rise speed substantially identical to the rise response speed of the magnetostrictive material. The time required for the pulse current to rise depends on an inductance L and an internal resistance r of the magnetostriction vibrator 21. However, the externally-provided resistor 15*b* is electrically series-connected to the magnetostriction vibrator 21 to cause the impact current whose rise is sharp to flow therein.

The impact current outputted from the high-speed switching circuit 15 produces a magnetic field having a magnitude proportional to the impact current in the magnetostrictive material by the excitation windings wound around the magnetostriction vibrator 21. Since a reaction produced in an anti-magnetic filed direction by eddy currents induced inside the magnetostrictive material can be neglected (the magnetostriction vibrator 21 is formed in a layer structure), the rise in the magnetic field produced inside the magnetostrictive material is equal to that in the impact current. Further, magnetic distortion or magnetostriction is produced at the rise speed determined depending on the inductance L of the magnetostriction oscillating element 21 and the resistance value R of the resistor 15*b*. An acceleration at the time of the occurrence of the magnetostriction is produced in the following manner. Assuming now that the quantity of the magnetostriction is represented as $\Delta 1$ and a rise time is represented as At, an acceleration a is approximately equal to $\Delta 1/(\Delta t)2$. When, for example, pure nickel is used as the magnetostrictive material, $\Delta 1$ and $\Delta t$ can be set to a few μm and several tens of μsec respectively. It is therefore possible to realize an acceleration of 1000 G or so.

Figure 22:
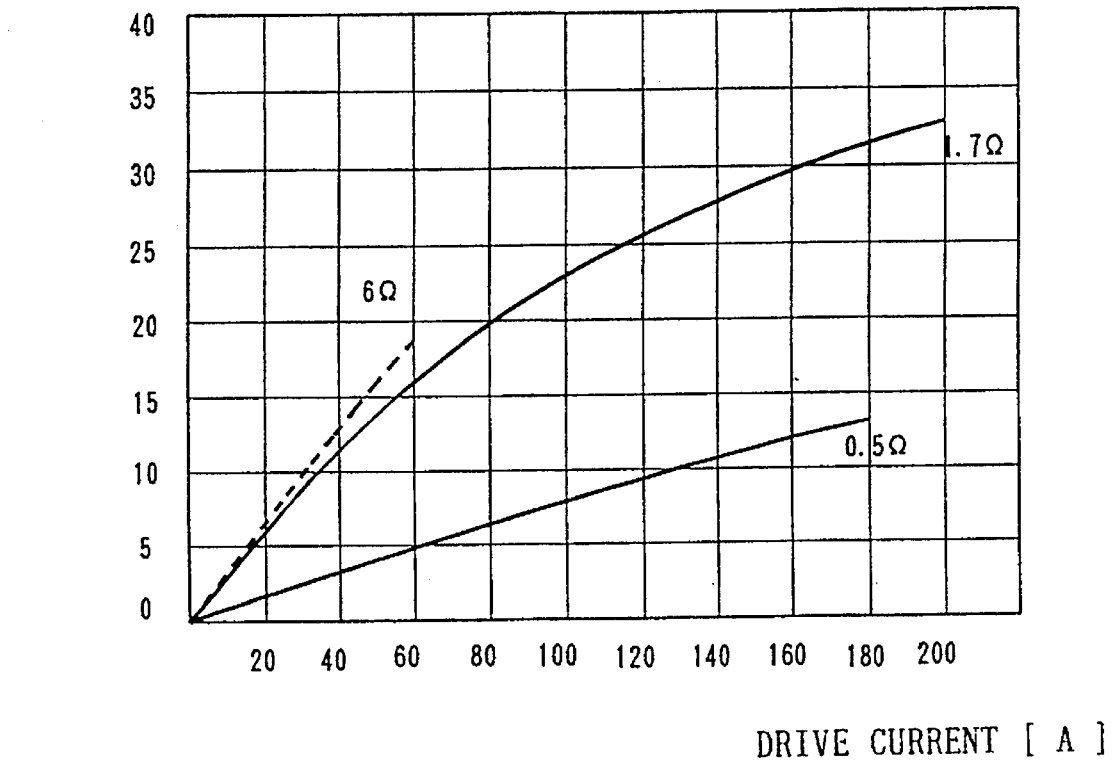
FIG. 22 is a graph for describing the relationship between a drive current and an acceleration both employed in the signal transmission system shown in FIG. 9.
Figure 23:
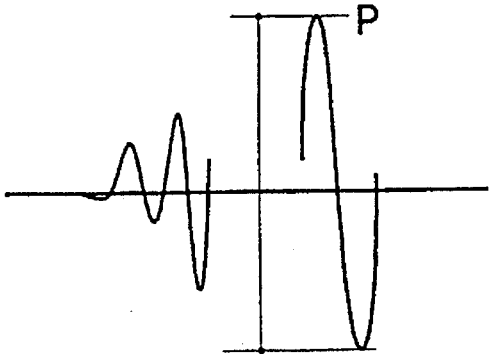
FIG. 23 is a waveform chart for describing the waveform of a propagated acoustic wave employed in the signal transmission system shown in FIG. 9.

A relationship between an acceleration and a drive current both produced in the magnetostriction vibrator 21 is shown in FIG. 22. As shown in FIG. 22, the acceleration developed in the magnetostriction vibrator 21 increases as the current supplied to its windings increases. When the acceleration exceeds a certain region, it tends toward saturation. This saturation phenomenon produced by the drive current takes place due to a saturation phenomenon with respect to the magnetic field of the magnetostriction. The relationship between the drive current and the acceleration, which is shown in FIG. 22, is shown as an illustrative example. According to this relationship, characteristics differ from each other in dependence upon the structure of the magnetostriction vibrator 21, a magnetic circuit and a transmission mechanism. Incidentally, the waveform of an output produced from the magnetostriction vibrator is shown in FIG.

23. In the same drawing, symbol P indicates the maximum peak value.

Figure 24:
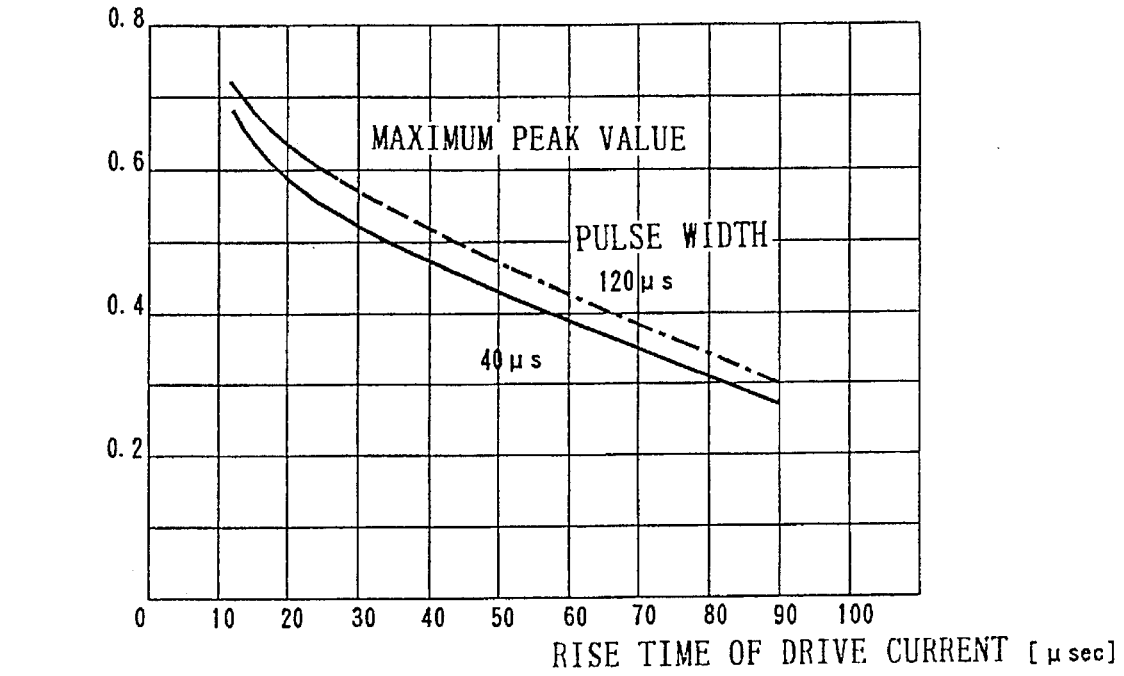
FIG. 24 is a graph for describing the relationship between a drive current and an acceleration both employed in the signal transmission system shown in FIG. 9.

A relationship between the acceleration developed in the magnetostriction vibrator 21 and the time required for the drive current to rise is shown in FIG. 24. The acceleration, which is produced as the rise time becomes short, increases. Further, the acceleration does not so depend on the width of a current pulse. The upper limit of an increase in the acceleration corresponds to the response time of the magnetostrictive material and a steep rise in the drive current beyond the above does not contribute to an increase in the acceleration.

Based on the foregoing fact, the present embodiment makes use of the structure of the high-speed switching circuit to generate an impactive and powerful acceleration.

Figure 20:
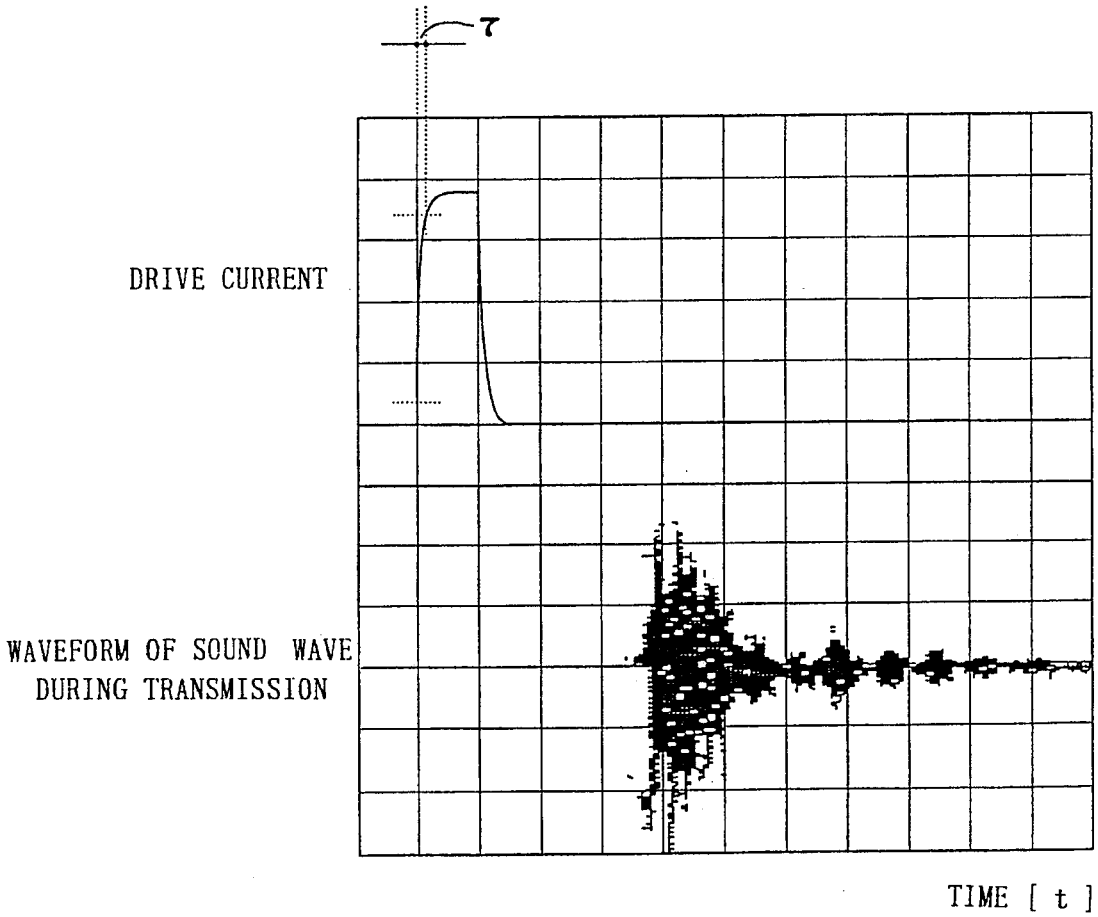
FIG. 20 is a waveform chart for describing waveforms of a drive current and a propagated acoustic wave both employed in the signal transmission system shown in FIG. 9.

When an impulsive force produced under such a sharp acceleration is transferred to the drill string as an acoustic signal, a rodlike-body grid or lattice and acoustic coupling are made to thereby produce an impulsive force shown in FIG. 20, which is incident to the acceleration, within a rodlike body. Incidentally, s in FIG. 20 represents a time required for the drive current to rise.

Figure 21:
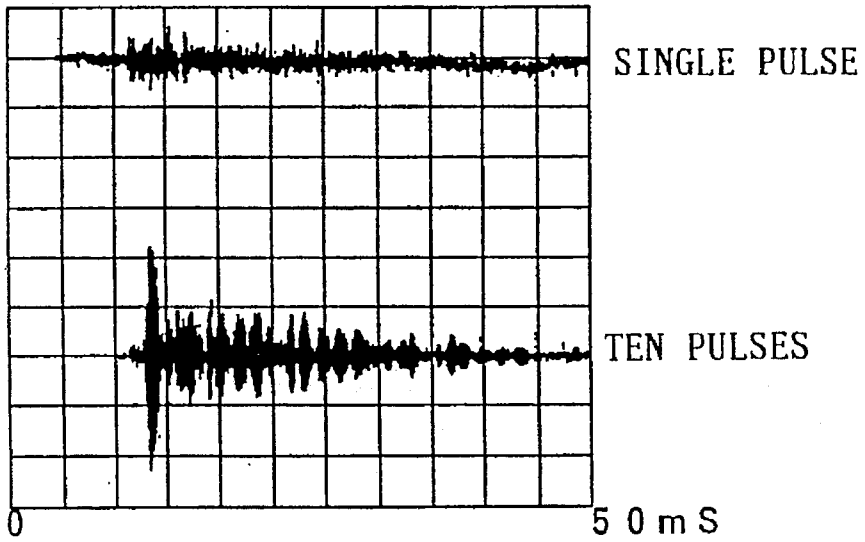
FIGS. 21(1) and 21(2) are respectively waveform charts for describing waveforms of a drive current and a propagated acoustic wave both employed in the signal transmission system shown in FIG. 9.
Figure 21:
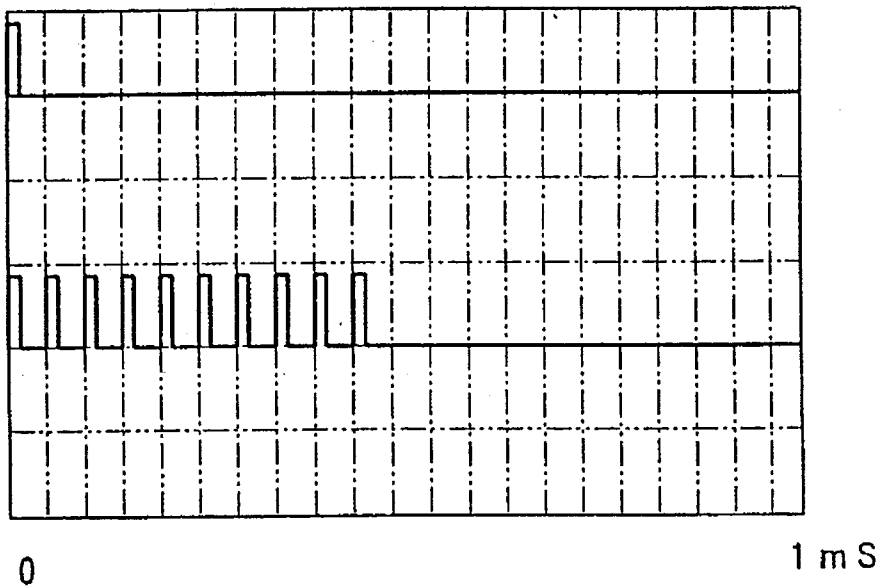

A drive current pulse for producing the impact wave in the magnetostriction vibrator 21 may use such a single drive pulse current as shown in FIG. 20. As shown at the low stages of FIGS. 21(1) and 21(2), a plurality of drive pulse currents may be produced at intervals in multiple form in such a manner that the peaks of an impact wave produced by these pulse currents are put in phase with each other and superposed on one another. FIGS. 21(1) and 21(2) are respectively waveform charts for comparing a single drive pulse (upper stage) and ten drive pulses (low stage) and describing the result of comparison. FIG. 21(1) shows the waveforms of the drive pulse currents whereas FIG. 21(2) illustrates the waveforms of the generated impact waves. As is apparent from the drawings, the peak value of the impact wave obtained when the ten drive pulses are used in multiple form has a magnitude of about ten times the peak value of the impact wave obtained when the single pulse is used. The application of the multipulses is controlled by the modulation circuit 12. The interval between the multiplexed pulses is set with the integral times the wavelength of a principal frequency of the impact wave as a base.

The modulation circuit 12 has a function for coding information detected by the detector 5 provided in the bottom of hole in digital form and modulating the coded information. The high-speed switching circuit 15 outputs a drive pulse train based on the modulated signal. In the present embodiment, the aforementioned impact modulation is carried out.

Figure 19:
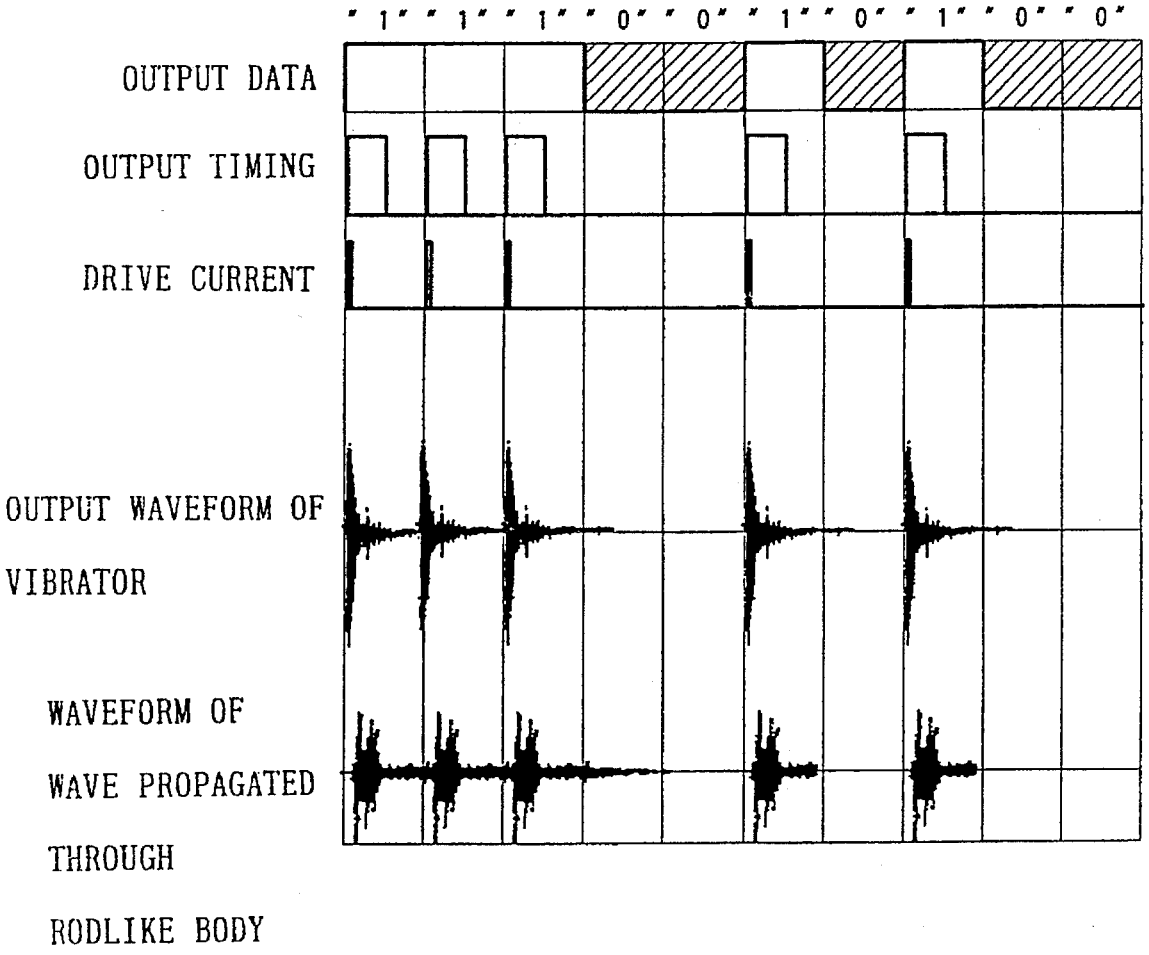
FIG. 19 is a waveform chart for describing waveforms of sound signals employed in the signal transmission system shown in FIG. 9.

The time intervals of the pulse train generated in accordance with the impact modulation are determined based on a propagation characteristic of the rodlike body. This decision is made because an acoustic wave propagated through the rodlike body is damped, reflected and dispersed upon its propagation and interference occurs between a sequence of pulses. Therefore, the information for each bit, which has been coded in digital form, is spaced by a time interval during which the information can be decoded by demodulation and the following one-bit information is thereafter transmitted. The output waveform of such a modulated signal is shown in FIG. 19. In FIG. 19, the first line represents bit information corresponding to output data and the second line shows an output timing for sending this information. The present drawing shows the case where data having a bit string of "1110010100" is transmitted. When the bit rate is 10 bit/sec, the output timing is taken at each 100 msec. When the bit rate is 100 bit/sec, the output timing is taken at each 10 msec. A drive current is output so as to correspond to the above output timing as indicated in the third line in FIG. 19. The magnetostriction vibrator 21 generates oscillations in association with the impact current as indicated in the fourth line in FIG. 19, so that such an impactive acceleration as indicated by the output waveform is produced. The waveform indicated in the final line in FIG. 19 corresponds to that of a wave propagated through the rodlike body, which is excited by an impulsive force associated with the acceleration.

As described above, it is necessary to drive the magnetostriction vibrator 21 with a current whose rise is sharp, in order to produce the impact wave. In order to realize a sharp rise characteristic, it is necessary to reduce the inductance L of each excitation winding of the magnetostriction vibrator 21. The externally-provided resistor **15*b* is also required as described above. However, the resistor 15*b*** becomes a factor of the power loss on the one side. Since the power producible in the bottom of hole is restricted, it is of extreme importance from the viewpoint of the design of an apparatus for the bottom of hole that a circuit constant capable of providing the minimum power loss while ensuring the sharp rise characteristic is selected.

Thus, a system for cutting off the current when the magnetostriction has reached a predetermined level was invented and applied to the present embodiment. This system will be described below.

Figure 25:
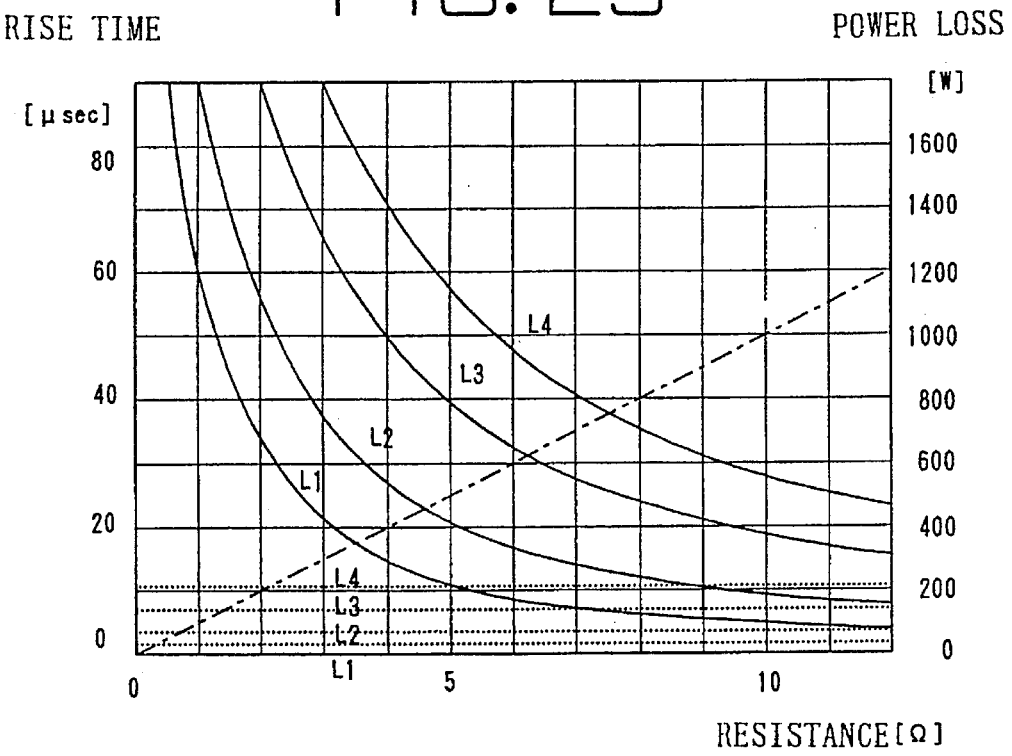
FIG. 25 is a graph for describing the relationship between a time required for a drive current employed in the signal transmission system shown in FIG. 9 to rise and a power loss.

FIG. 25 illustrates a relationship (indicated by solid lines in the drawing) between excitation windings, an external resistance value and a rise time and a relationship (indicated by broken lines in the drawing) between the external resistance value and the power loss at the resistor **15*b*. The rise time can approximate about L/R expressed by the inductance (L1, L2, L3 and L4) of the magnetostriction vibrator 21 and the resistance value R. In the drawing, the inductances L1, L2, L3 and L4 are represented as $L1<L2<L3<L4$. On the other hand, the power loss at the resistor 15*b*** is represented in the form of $I2R\times\Delta T\times BR$. Here, $\Delta T$ represents the width of the current impulse and BR indicates the bit rate. Incidentally, a dashed line in the drawing shows the manner of a variation in the rise time according to a variation in the resistance value R when the impulse is outputted with its width held constant.

The more the inductance of each excitation winding increases, the more the magnetic field produced in the magnetostriction vibrator 21 becomes strong. It is however useless that the magnetic field is made strong beyond need because the magnetostriction exhibits the saturation phenomenon. The inductance of the excitation winding is preferably decreased from the standpoint of the occurrence of the sharp pulse.

When the resistance value R is increased, the rise time becomes shorter but the power loss increases. On the other hand, when the resistance value R is reduced, the power loss at the resistor **15*b*** becomes smaller but the rise time is made longer, thus making it difficult to produce sharp acceleration. It is thus understood that it is most suitable to set the resistance value R for realizing an answerable limitation rise time exceeding a physical response time to the magnetostriction.

Circuit constants of both the inductance L of each excitation winding and the resistance value R will be determined based on the above points as follows:

(1) Inductance L: inductance capable of producing a magnetizing force or magnetic filed strength H (about 10 oersteds) corresponding to the magnetostriction saturation (2) Resistance R: resistance value capable of providing a rise time equivalent to a response time to magnetostriction for the inductance L.

Now, consider that the width of the impulse is set equal to the rise time L/R of the magnetostriction. In this case, the power loss at the resistor 15*b* is represented as I2L×BR and does not depend on the resistance value R as indicated by the dashed line in the drawing.

When the magnetostriction vibrator 21 is mounted in the vibrator sub 2, a single magnetostriction vibrator 21 may be mounted in the vibrator sub 2. However, a plurality of magnetostriction oscillators or vibrators 21 may be disposed on a pipe or tubular body as shown in FIGS. 30 and 31 or FIGS. 32 and 33 (which respectively show one form of mounting of magnetostriction vibrators in a small-diameter oscillator or vibrator sub). In this case, when these magnetostriction vibrators 21 are driven, their corresponding drive circuits are parallel-connected to one another. When four magnetostriction vibrators 21 are disposed, for example, excitation windings are respectively wound around them and externally-provided resistors 15*b* may individually be connected to the excitation windings. Alternatively, a single externally-provided resistor 15*b* may be connected to four excitation windings. In the latter case, the resistance value R of the externally-provided resistor 15*b* is set to ¼ of the four. In this case, the number of the externally-provided resistors 15*b* can be reduced so as to contribute to a reduction in cost and a size reduction in form of the vibrator sub 2.

A relationship between the bit rate and the power to be used up can be represented as W=VI×ΔT×BR. An increase in the bit rate increases the power consumption of a power supply provided in the bottom hole. Therefore, a function for reducing a current value or reducing the width of an impulse to thereby output a desired current is required to ensure a predetermined bit rate within a range at which power can be supplied based on the capacity of the power supply. To realize it, a function for adjusting the pulse control of the switching control circuit 15*c* and controlling the pulse width is also incorporated in the modulation circuit 12.

Figure 15:
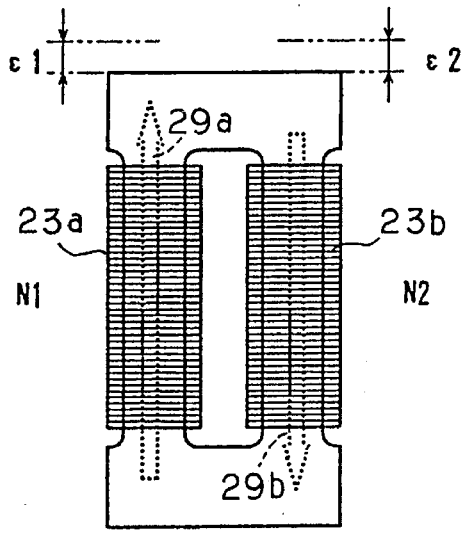
FIG. 15 is a side view showing the configuration of a magnetic circuit of a magnetostriction oscillating device employed in the signal transmission system shown in FIG. 9.
Figure 16:
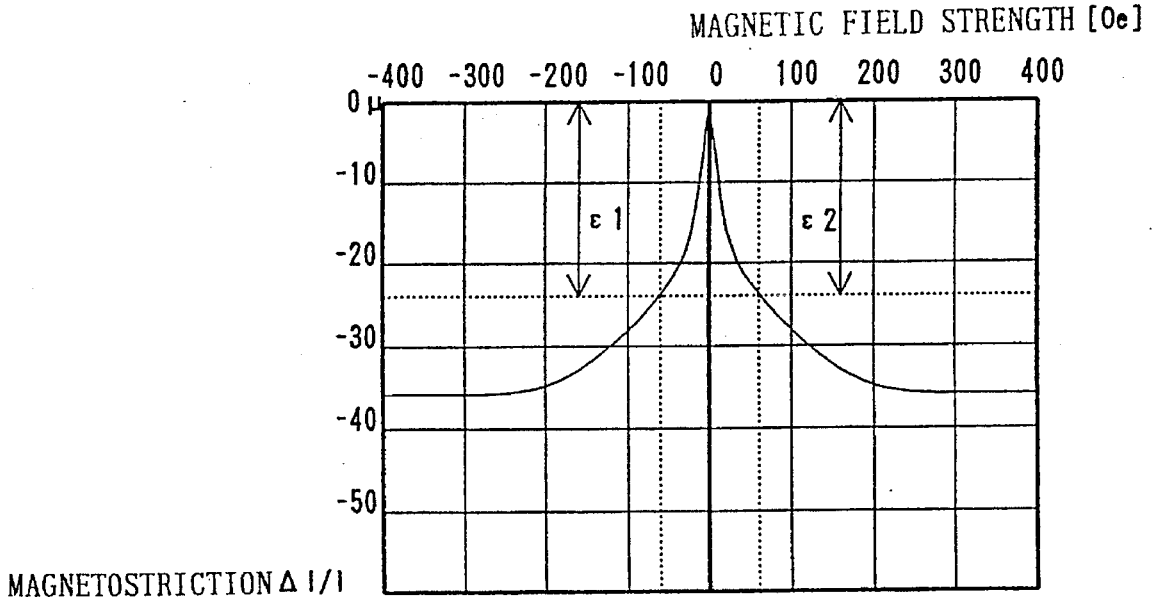
FIG. 16 is a graph illustrating a magnetic characteristic of a magnetostrictive material employed in the signal transmission system shown in FIG. 9.

FIG. 15 is a side view of a magnetic circuit of the magnetostriction vibrator 21. FIG. 16 shows a graph of a magnetostrictive characteristic of one example (pure nickel) of a magnetostrictive material.

As magnetostrictive materials for producing distortion under the application of a magnetic field thereto, there are known those such as metallic magnetostrictive materials such as nickel, cobalt, etc. Further, there are known those such as Terfenol-D serving as a supermagnetostrictive material, etc. In the present embodiment, for example, a nickel magnetostrictive material is used as a metallic material whose strength is high. Thus, the magnetostrictive material can withstand a pre-load for efficiently transferring an acoustic wave to a rodlike body, so that a pre-load mechanism can be adopted. The nickel magnetostrictive material has a high Curie temperature of 358° C. and can obtain a stable characteristic under a high-temperature environment.

The magnetostriction of the magnetostrictive material, which is produced under the application of the magnetic field thereto exhibits a characteristic in which the material expands and contracts in one direction regardless of the direction of the magnetic field. The magnetostrictive material made up of the pure nickel has a characteristic in which it contracts in a magnetic-field direction under the application of the magnetic field to the magnetostrictive material. This characteristic is represented in the form of the graph shown in FIG. 16. When the form of the magnetostriction vibrator 21 is shaped as a closed circuit as shown in FIG. 15 and excitation windings 23*a* and 23*b* are respectively wound around the magnetostriction vibrator 21 at the same number of turns N1 and N2 in the opposite direction, magnetic fields produced in the magnetostriction vibrator 21 by the excitation windings 23*a* and 23*b* are formed so as to magnetically serve as a closed circuit inside the magnetostrictive material. The magnetic fields 29*a* and 29*b* at both vanes or wings of the magnetostriction vibrator 21 travel in the direction opposite to each other but variations ∈1 and ∈2 in magnetostriction at an end face on the longitudinal side of the magnetostriction vibrator 21 occur in the same direction as seen on either side thereof. Therefore, the magnetostriction vibrator 21 expands and contracts in its longitudinal direction as a whole. In other words, a magnetic return circuit arrangement also contributes to provide the magnetostriction vibrator 21 which effectively acts on the magnetostriction and whose magnetic leakage is extremely small.

FIGS. 17(1) and 17(2) are respectively perspective views for describing the structure of a magnetostriction vibrator 21. In the drawing, reference numeral 22 indicates a magnetostrictive material shaped in the form of a core. Reference numeral 23 indicates each of excitation windings wound around the magnetostrictive material in the direction orthogonal to the direction in which the magnetostrictive material 22 is distorted. Each excitation winding 23 is supplied with an exciting current so as to generate a magnetic field at the magnetostrictive material 22. As a result, a steep magnetostrictive phenomenon occurs in the magnetostrictive material 22 due to the generated magnetic field.

When a sharp impact current is supplied to each excitation winding 23 to apply the magnetic field to the magnetostriction material 22, the magnetostrictive material 22 reacts to a variation in the magnetic field when it is made up of a metal such as nickel to thereby produce a phenomenon that eddy currents are induced inside the magnetostrictive material 22 in the direction in which an external magnetic field is counteracted within a cross-section (surface orthogonal to the magnetic field) of the magnetostrictive material 22 so that an effective magnetic field is not applied to the inside of the magnetostrictive material 22. In order to avoid the occurrence of this phenomenon, the magnetostrictive material 22 is constructed by stacking thin plate-shaped magnetostrictive materials 22a shown in FIG. 17(2) on one another in layer form with insulating layers respectively interposed therebetween in such a way as to make it hard to produce the eddy currents within the cross-section orthogonal to the magnetic field. In doing so, the magnetostrictive phenomenon, which has occurred only in the skin or surface of the magnetostrictive material, can be generated over the entirety of the inside of a stacked magnetostrictive structure.

Figure 30:
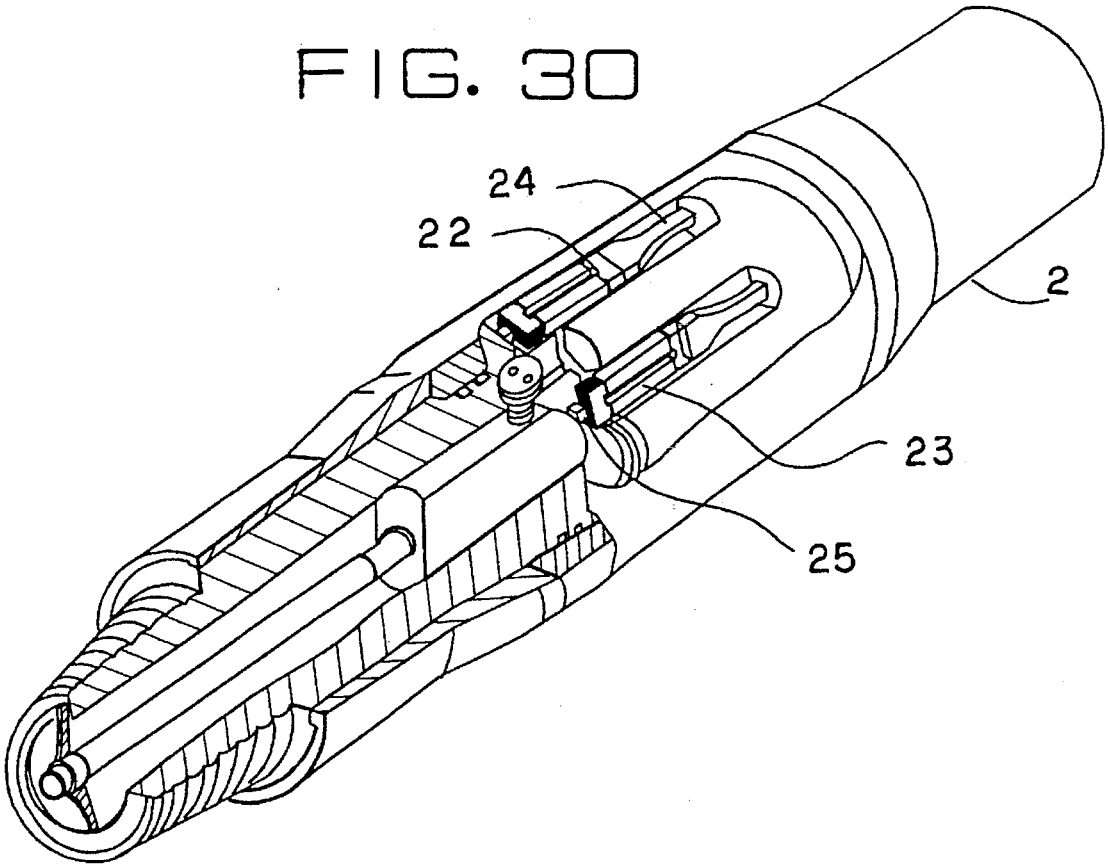
FIG. 30 is a perspective view showing the magnetostriction oscillating device shown in FIG. 28.
Figure 31:
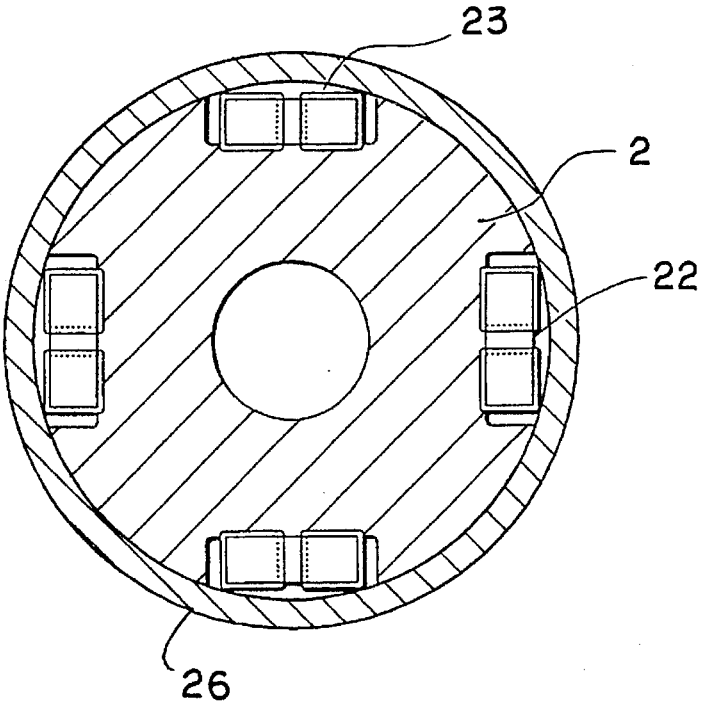
FIG. 31 is a cross-sectional view depicting the magnetostriction oscillating device shown in FIG. 30.
Figure 32:
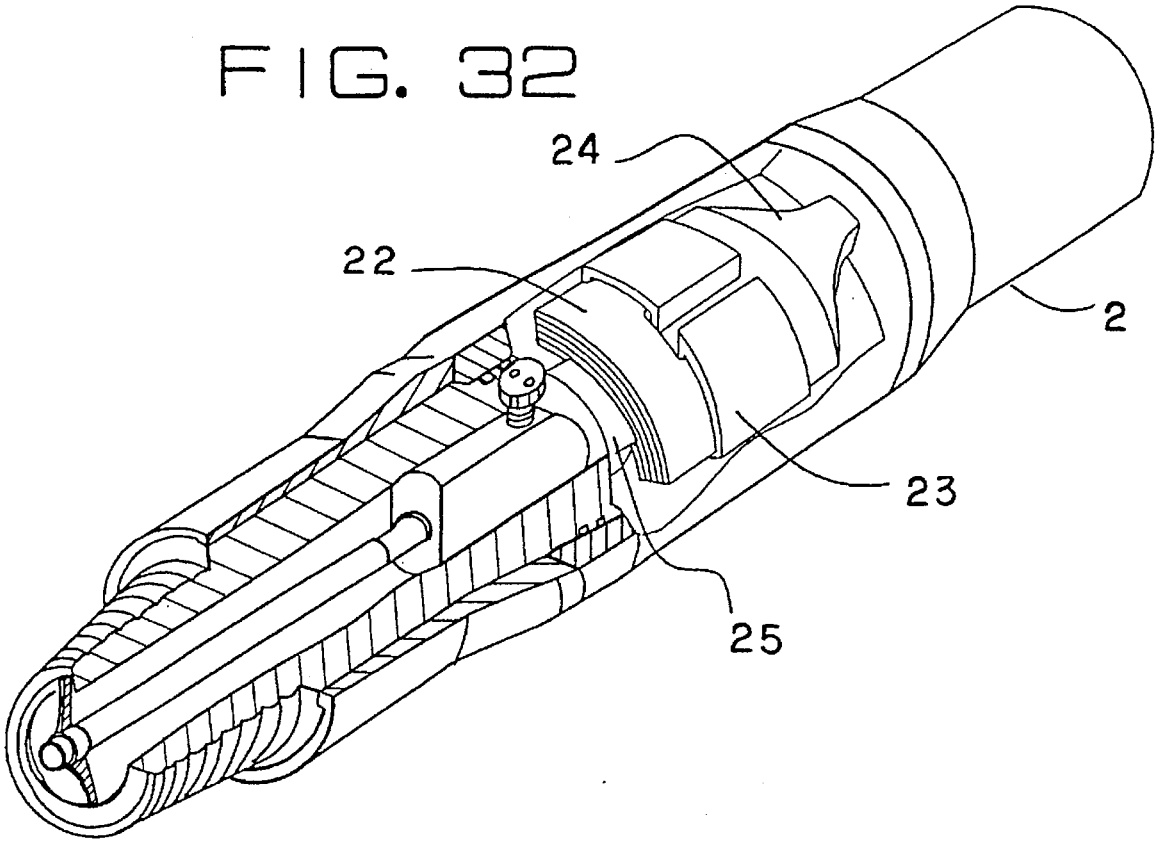
FIG. 32 is a perspective view illustrating the structure of another magnetostriction oscillating device employed in the signal transmission system shown in FIG. 9.
Figure 33:
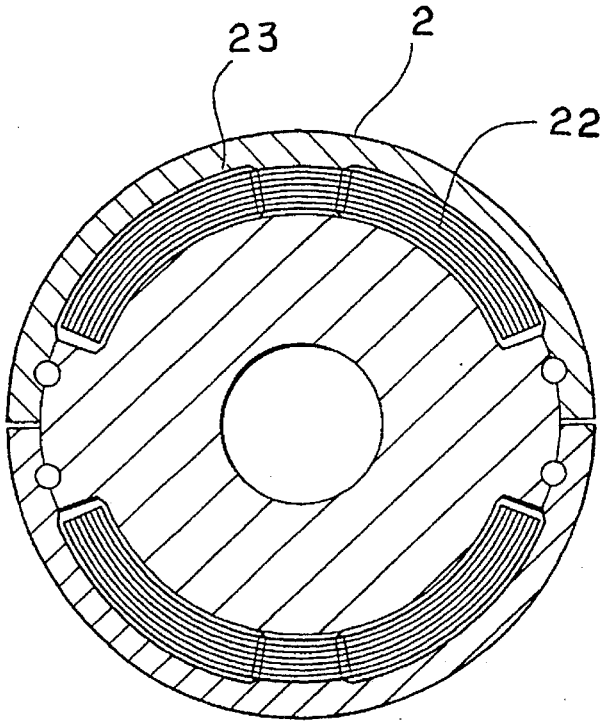
FIG. 33 is a cross-sectional view depicting the structure of the magnetostriction oscillating device shown in FIG. 32.

FIG. 30 is a partly cut-off perspective view of the vibrator sub 2. FIG. 31 is a cross-sectional view of the vibrator sub 2. In the drawing, reference numeral 24 indicates each of acoustic horns each joined onto an acoustic radiant surface of the magnetostrictive material Reference numeral 25 indicates each of pre-load mechanisms each for supplying pressure to the acoustic horns 24 and a transfer surface of a rodlike body. The vibrator sub 2 serves as a drill collar of a type wherein an outer peripheral portion of the rodlike body (whose inside is shaped in the form of a hollow pipe or a hollow tubular body in the present embodiment) is formed as a mounting box or case to mount the magnetostriction vibrators 21, the magnetostrictive materials 22, the excitation windings 23, the acoustic horns 24 and the pre-load mechanisms 25 therein. Reference numeral 26 indicates a protection outer cylinder for protecting or blocking each magnetostriction vibrator 21 from muddy water and pressures in the bottom hole. The cross-section of FIG. 31 shows the manner in which the four magnetostriction vibrators 21 have been arranged to strengthen an exciting force to be transferred to a drill pipe. Incidentally, threaded portions for a rotary tool joint based on the API Standard are provided at both ends of the vibrator sub 2 so as to be connected to a drill string.

Since an arrangement or layout structure of such a type that the magnetostriction vibrators 21 are directly mounted in the drill collar, the pressures are supplied by the pre-load mechanisms 25 and the parallel and direct exciting force is transferred to the magnetostrictive transfer surface and the drill pipe is used in this way, the efficiency of transfer of the exciting force produced by each magnetostriction vibrator 21 thereto is extremely high in the present embodiment. Further, since the arrangement of mounting the magnetostriction vibrators 21 in the drill collar is made, an advantageous effect can also be obtained that no restrictions are imposed on digging work.

FIGS. 26 through 29 are respectively views for describing the manner of mounting of each magnetostriction vibrator 21 employed in the present embodiment in further detail. In the respective drawings, reference numeral 24a indicates a tail of the acoustic horn 24. Reference numeral 25*a* indicates a screw jack of the pre-load mechanism 25. Reference numeral 25*b* indicates a head of the pre-load mechanism 25. Reference numeral 25*c* indicates an exciting-force absorption alloy block for absorbing an exciting force produced in an anti-transfer direction by the magnetostriction vibrator 21. Reference numeral 120 indicates a mounting box serving as a groove for accommodating the magnetostriction vibrator 21 therein, which is defined in a drill collar 102*a*. Reference numeral 120*a* indicates a fitting groove defined in the drill collar 102*a* to receive the tail 24*a* of the acoustic horn 24 therein. Reference numeral 120*b* indicates a concave portion corresponding to a recess defined in the drill collar 102*a* to receive the head 25*b* of the pre-load mechanism. Reference numerals 130*a* and 130*b* respectively indicate drill-pipe coupling screws. Reference numeral 221 indicates a fixing bolt for fixing the protection outer cylinder 26 to the drill collar 102*a*. Reference numeral 222 indicates an O ring for securely fixing the protection outer cylinder 26 to the drill collar 102*a*.

It is necessary to bring the magnetostriction vibrator 21 employed in the present embodiment into reliable contact with the transfer surface in order to efficiently transfer a sharp exciting force generated by the magnetostriction vibrator 21 to the tubular body and securely transmit it thereto from the viewpoint of the mechanical strength. That is, there is a risk that when there is a space defined between a wall surface of the magnetostriction vibrator 21 and a wall surface of the drill collar 102*a*, the breakdown by impact occurs in the wall surfaces of the magnetostriction vibrator 21, the acoustic horn 24 and the drill collar 102*a*, for example, due to an exciting force produced by steep magnetostriction. Therefore, the above pre-load is made to securely bring the magnetostriction vibrator 21 into contact with the wall surface of the drill collar 102*a* so as to prevent the occurrence of the impact fracture. When the magnetostriction vibrator 21 is actually mounted in the drill collar 102*a*, the magnetostriction vibrator 21 is inserted into the mounting box 120. Thereafter, the screw jack 25*a* of the pre-load mechanism 25 may be rotated so as to stretch or extend the pre-load mechanism 25. In doing so, the pre-load head 25*b* and the horn tail 24*a* are securely fitted in their corresponding concave portion 120*b* and fitting groove 120*a* so that no space is defined between the magnetostriction vibrator 21 and the drill collar 102*a*.

Taking into consideration the amount of magnetostriction produced from a saturated magnetostriction value (λ) of the magnetostrictive material 22, the difference between linear expansion coefficients of respective materials under a high-temperature environment and the amount of compressive strain of the drill collar 102*a* under the drilling or digging load (Weight On Bit) applied to the drill collar 102*a* upon drilling, the pre-load associated with the depth obtained by drilling or the like is set in such a manner that the tail 24*a* of the acoustic horn 24 is pressed against the wall surface of the fitting groove 120*a* of the drill collar 102*a* under a suitable pressing force. It is needless to say that the pre-load mechanism 25 is not limited to or by the mechanism employed in the present embodiment. The pre-load mechanism 25 may be either a hydraulic cylinder type device or a hydraulic-pressure actuator type mechanism using bottom-hole pressures.

The acoustic horn 24 is joined to a radiant surface of the magnetostriction vibrator 21 to efficiently transfer the sharp exciting force produced by the magnetostriction vibrator 21 to the drill collar 102*a* upon transfer of the energy to the drill collar 102*a*. The acoustic horn 24 has a structure of an exponential configuration equivalent to an ideal shape for concentrating the energy thereon. Further, the acoustic horn 24 (exponentially) concentrates the density of energy of an exciting force generated under an impactive acceleration thereon and amplified it. Thereafter, the acoustic horn 24 efficiently injects the so-processed energy into the drill collar 102*a*.

In the present embodiment, the magnetostriction vibrator 21 of such a type that the thin plate-like magnetostrictive materials 22*a* are stacked on each other to create the magnetostrictive material 22, is used. However, the structure of the magnetostrictive material for the magnetostriction vibrator is not necessarily limited to the layered structure. Other types such as a rectangular-shaped core-type transformer structure, etc. may be used.

Figure 34:
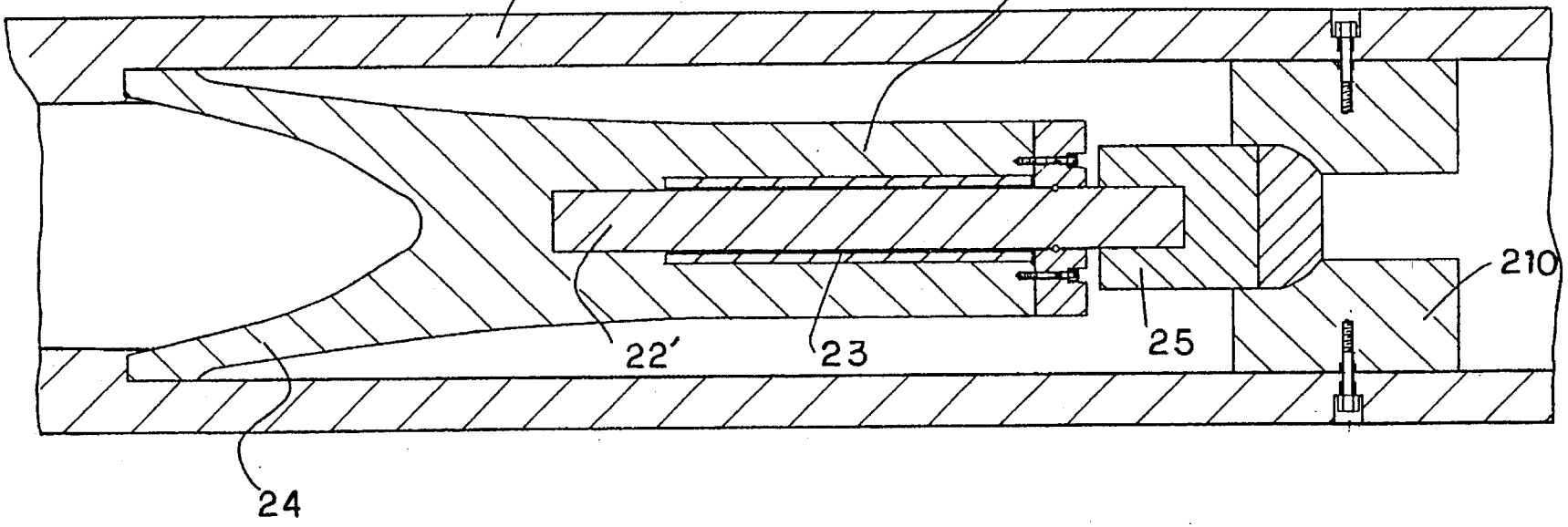
FIG. 34 is a cross-sectional view showing the structure of a further magnetostriction oscillating device employed in the signal transmission system shown in FIG. 9.

FIG. 34 is a cross-sectional view showing one example of a solid-type magnetostrictive material. In the drawing, reference numeral 22' indicates a solid-type magnetostrictive rod. Reference numeral 210 indicates a mechanism for supporting a pre-load mechanism 25. Reference numeral 212 indicates a magnetic return circuit used for forming a magnetic closed circuit.

Figure 26:
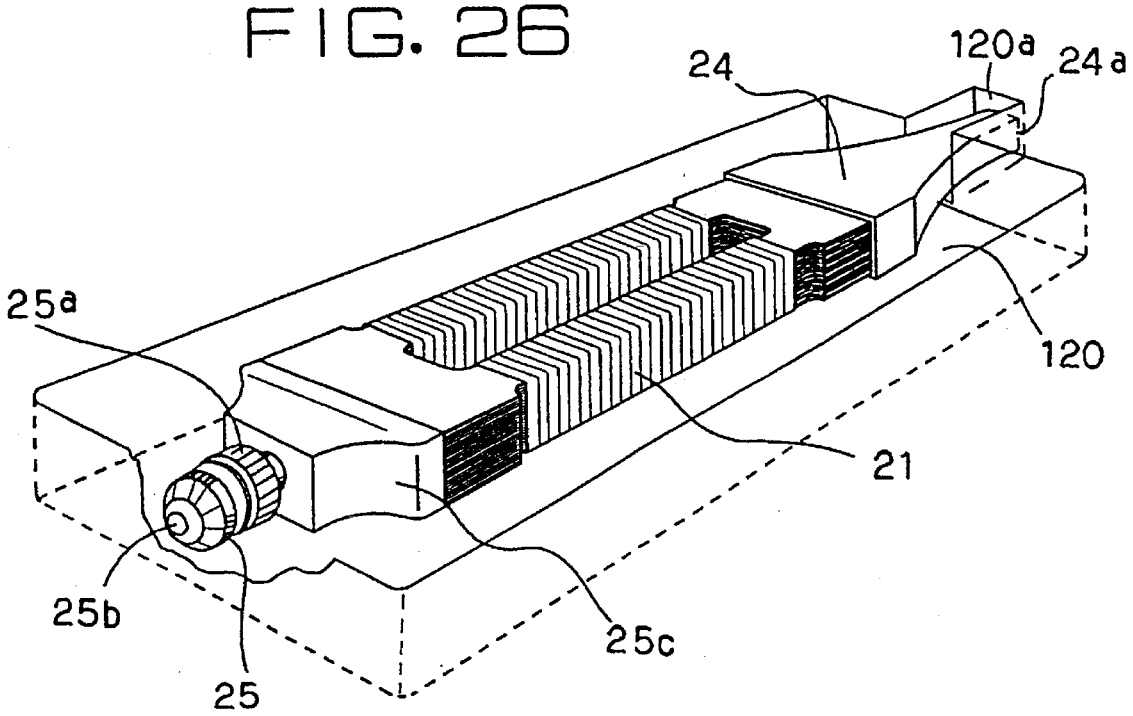
FIG. 26 is a perspective view showing the structure of the magnetostriction oscillating device employed in the signal transmission system shown in FIG. 9.
Figure 27:
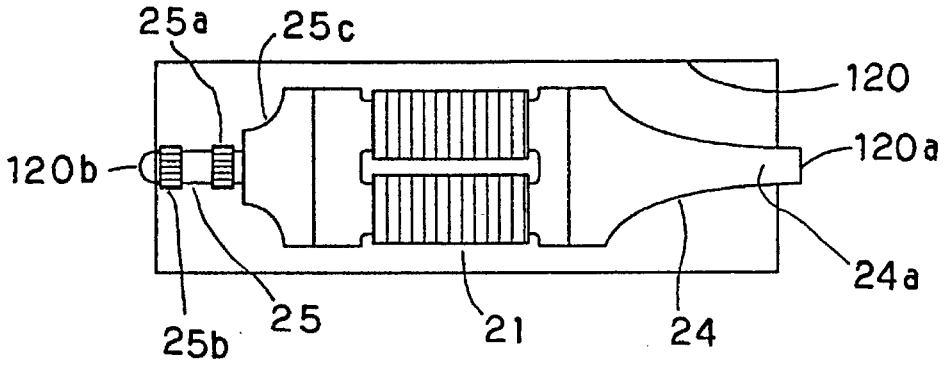
FIG. 27 is a plan view illustrating the structure of the magnetostriction oscillating device employed in the signal transmission system shown in FIG. 9.

The magnetostriction vibrator comprised of the solid-type magnetostrictive material formed of a single material in this way is different from the magnetostriction vibrator made up of the stacked magnetostrictive material and simple in structure. When the magnetostriction vibrator cannot be fixed onto a tubular wall of a drill collar 102*a*, for example, the solid-type magnetostrictive material has a merit in that the degree of freedom of the position where the magnetostriction vibrator is provided, is large. FIG. 26 shows one example in which the magnetostriction vibrator has been mounted in the central position of the drill collar 102.

Figure 35:
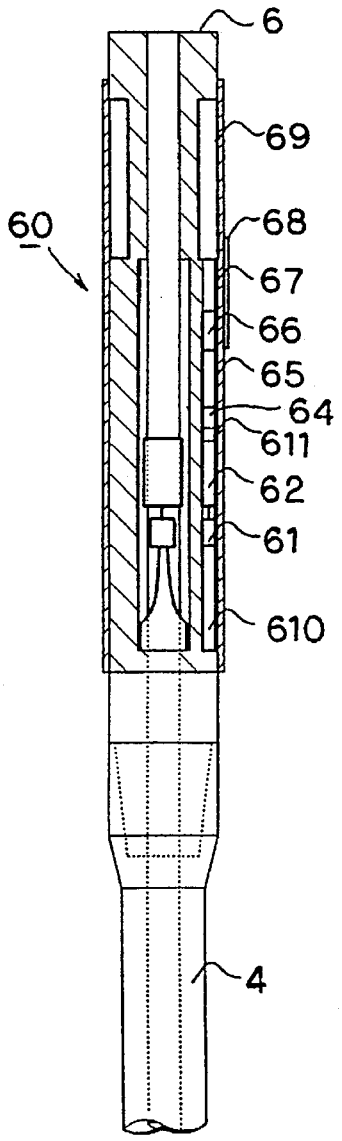
FIG. 35 is a view for describing a spatial layout of an acoustic wave receiver employed in the signal transmission system shown in FIG. 9.
Figure 36:
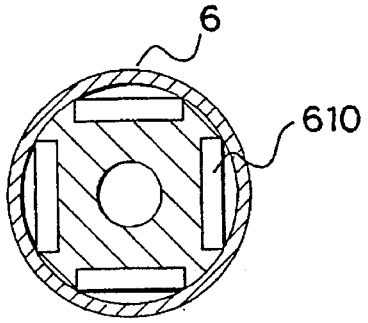
FIG. 36 is a cross-sectional view illustrating the acoustic wave receiver shown in FIG. 35.
Figure 37:
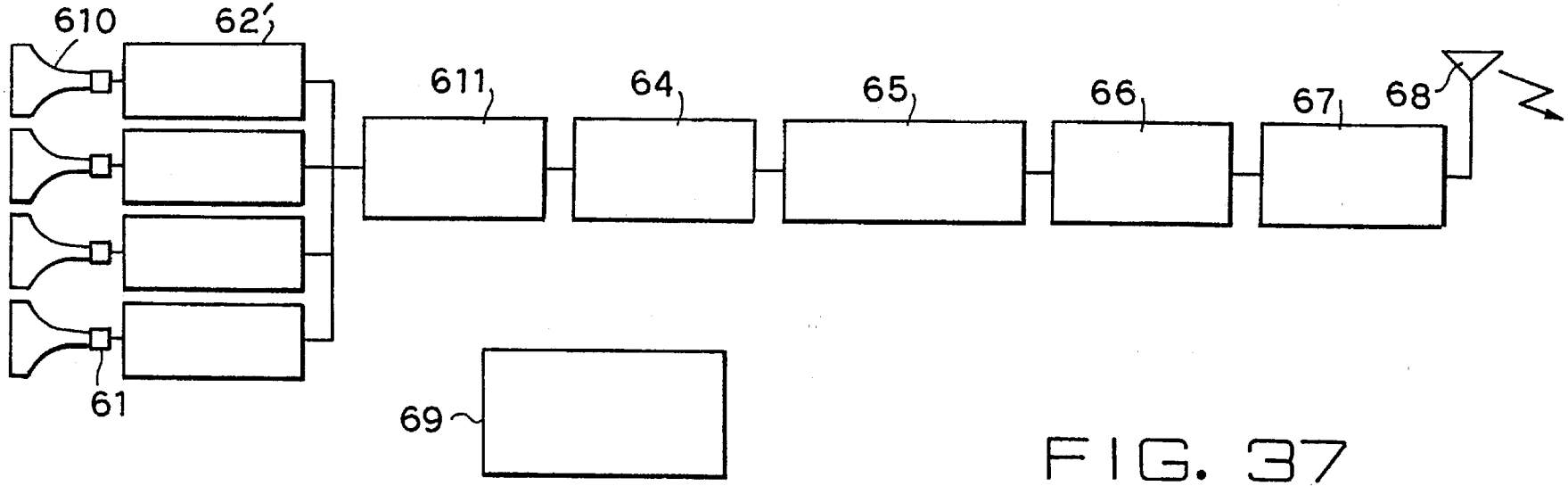
FIG. 37 is a block diagram showing a circuit configuration of the acoustic wave receiver shown in FIG. 35.

FIG. 35 is a partly cut-off side view showing a layout relationship between respective components of a modification of an acoustic wave receiver 60 mounted in a receiver sub 6. FIG. 36 is a cross-sectional view of the modified acoustic wave receiver 60. FIG. 37 is a block diagram showing a circuit configuration of the acoustic wave receiver 60. In the drawing, reference numeral 610 indicates an acoustic horn for concentrating acoustic signals propagated through a drill pipe 4 thereon. In the modification, four acoustic horns 610 are mounted on an inner wall of the receiver sub 6 as shown in FIG. 36. Acoustic detectors 61 are attached to sound-collecting portions of the respective acoustic horns one by one. Reference numerals 62' respectively indicate filter units each of which has a high-pass filter and a highly sensitive amplifier for amplifying a signal outputted from the high-pass filter. An input terminal of each filter unit 62' is electrically connected to an output terminal of each acoustic detector 61. Reference numeral 611 indicates an adder which adds together signals outputted from the respective filter units 62' and outputs the result of addition therefrom. A detector circuit 64 includes a first-stage square-law detector circuit and a plurality of stages of square-law detector circuits subsequent to the first-stage square-law detector circuit, and a low-pass filter for performing the effects of an envelope detector circuit electrically connected to an output terminal of each of the square-law detector circuits. Reference numeral 69 indicates each of complex batteries which serve as battery units for individually outputting power-supply voltages necessary for respective circuit units. Since the individually required power-supply voltages are obtained from the batteries in this way, it is unnecessary to provide a converter. Thus, noise such as switching noise, etc. is no longer produced and the entire structure also becomes simple.

The receiver sub 6 is coupled to the uppermost stage of a drill pipe 102 of a drilling rig 101 or a kelly (drill-pipe holding device) with screws.

The operation of the present modification will now be described below. A high-frequency acoustic signal propagated through the drill pipe 102 is scaled up or amplified by each of the acoustic horns 610. Thereafter, the amplified acoustic signal is converted into an electric signal by each acoustic detector 61. Each of the filter units 62' removes noise of low-frequency components and unnecessary components from a signal outputted from each of the acoustic detectors 61 and amplifies the so-processed signal with high gain. The signals outputted from the respective filter units 62' are added together by the adder 611 and the detector circuit 64 performs square-law detecting and envelope detecting processes on the added signals. In accordance with the square-law detecting process, small signals caused by noise are restrained or controlled so that effective components corresponding to a true signal caused by an impact wave are amplified. If the square-law detector circuits are provided in the form of plural stages and the square-law detecting process is effected several times, then the S/N ratio is improved. The signal subjected to the square-law detecting process passes through a low-pass filter associated with a band taken up or occupied by an envelope signal of the impact wave so as to be subjected to the envelope detecting process, whereby the waveshape of the acoustic signal of the impact wave can be recognized and stably demodulated.

The signal outputted from the detector circuit 64 is subjected to the signal processing by the signal processor 65. In order to extract a signal waveform to be transmitted, a signal transmitting period on the transmission side is first detected and signal sampling is made in synchronism with the detected signal transmitting period. Alternatively, when a window used for inputting a signal is opened and locations from which signals are expected to arrive are selectively input as data, a stable demodulating process capable of providing a higher S/N ratio can be performed without taking in the unnecessary components. Further, a process for predicting the influence of the reflection and resonance of a signal at a connecting portion of the drill pipe 102 in the drill string, checking received data based on the predicted values corresponding to the influence and demodulating the received data having high reliability is executed. The values obtained by predicting the influence of the reflection and resonance may be stored in a memory in advance. Alternatively, a momentary calculation may be made to what kind of waveform the subsequent signal corresponds each time one-bit signal is received. Thus, the signal processor 65 determines the transmitting waveform having high reliability and a good S/N ratio and thereafter converts information about its waveform into the original transmitting information inclusive of a predetermined transmission-pulse interval. The signal outputted from the signal processor 65 is radio-modulated by the radio-transmission modulator 66 and transmitted by a radio wave through the radio transmitter 67 and the transmitting antenna 68. Since the acoustic wave is detected by the plurality of acoustic detectors 61 in the present modification, an improvement in the S/N ratio and an increase in signal detection performance can also be effected.

Figure 28:
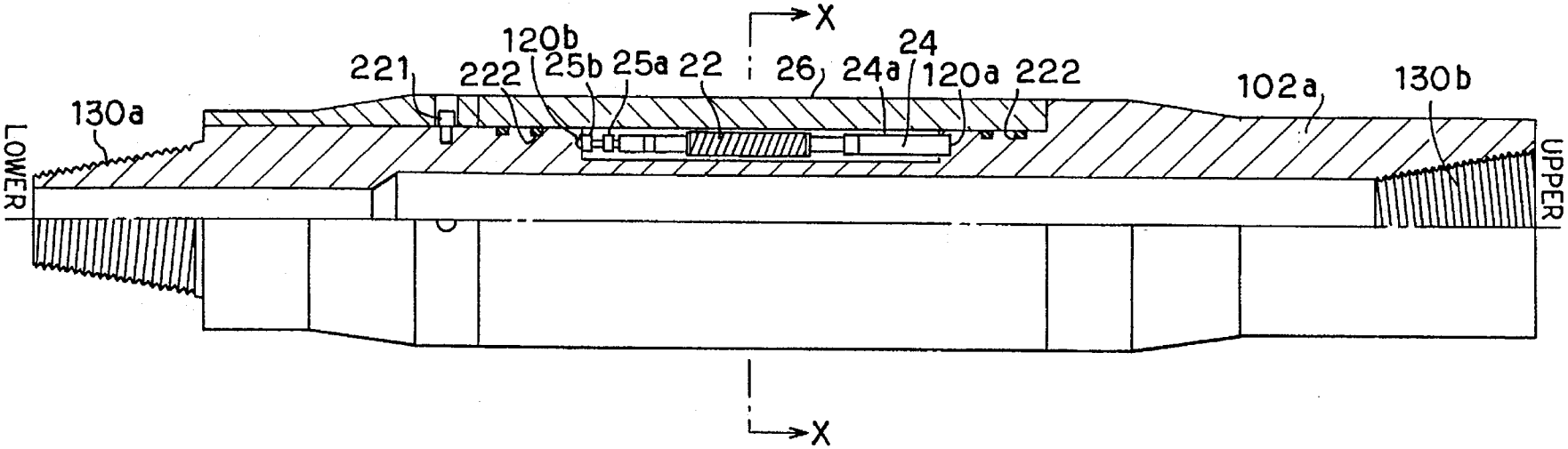
FIG. 28 is a partially cut-off side view showing the structure of the magnetostriction oscillating device employed in the signal transmission system shown in FIG. 9.
Figure 29:
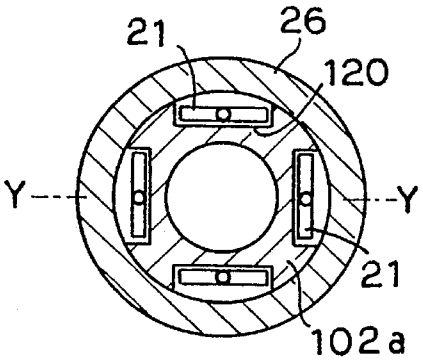
FIG. 29 is a cross-sectional view illustrating the magnetostriction oscillating device shown in FIG. 28.

When the stacked magnetostrictive material 22 is heated to 700° C. or so and subjected to annealing, a material whose crystal orientation is uniform and which is good in quality can be obtained. In the present invention as well, since the box groove or hole capable of mounting the magnetostriction vibrator therein from the external surface (or internal surface) of the wall of the drill collar 102*a* has been defined as shown in FIG. 28, the magnetostriction vibrator can be efficiently mounted in the box hole. Further, if a magnetostrictive element is used as each acoustic detector 61, then an acoustic signal can be detected in a state in which acoustic impedance at a receiving unit has been minimized, thus enabling a highly sensitive signal reception. Since the Curie temperature of the magnetostrictive element is high, a receiving system capable of being operated even under a high-temperature environment can be constructed. Further, when the sharing between the transmitter and the receiver can be made and they are used as a bidirectional signal transmission system, a compact and efficient signal transmission system can be constructed.

Incidentally, the term "rodlike body" in the present specification includes a hollow pipe or tubular body as well as a so-called "rod" whose contents have been packed up to its incenter. Further, its material may be one such as ceramic as well as a metal. That is, it may be a solid capable of transmitting an acoustic wave.

The present invention has described the drilling of the petroleum well as an illustrative example. However, the use of the present invention is not necessarily limited to this example. The present invention can be used as an information transmission device for an MWD system employed upon drilling a geothermal well or the like and an information transmitting means for an automatic or mechanical drilling device, which is employed in pipe arrangements of a power cable, a telephone cable, etc. Further, the present invention can be used as a source for generating artificial earthquakes and applied to a non-destructive inspection, a diagnosis and the like of an object existing at a long distance. The application of the present invention to the non-destructive inspection, the diagnosis and the like of the object may specifically be mentioned as follows. By momentarily exciting or vibrating structures such as lines, bridge beams, tunnels, towers mounted over a long distance and measuring an acoustic wave reflected from the structures or a wave transmitted through the structures, defects can be inspected, monitored and diagnosed nondestructively during the operation of the structures.

According to the first aspect of this invention, as has been described above, an advantageous effect can be brought about in that since an ultrasonic wave is produced by a magnetostrictive phenomenon and transmitted through a rodlike body, maintenance is easy, a signal transmission can be reliably effected even when a long drill string is used, and a pre-load required to transmit an acoustic wave to a pipe or a tubular body can be sufficiently applied thereto.

According to the second aspect of this invention as well, an advantageous effect can be brought about in that since a magnetostrictive phenomenon that rises at high speed is produced and an impulsive force produced according to an acceleration at the time of the occurrence of sharp magnetostriction is transmitted to the rodlike body, an electrical and mechanical acoustic coupling, which is efficient at an impact reaction region, can be realized so that the impulsive force can be converted into a large ultrasonic energy, thereby making it possible to transmit a signal at a high bit rate.

Further, according to the third aspect of this invention, an advantageous effect can be brought about in that since thin plate-like magnetostrictive materials are stacked on one another, an eddy-current loss of each magnetostrictive material, which is produced according to a variation in drive current flowing in a magnetostrictive element, is reduced, magnetostriction is produced up to the inside of the magnetostrictive element, and an output corresponding to several times the output of a magnetostrictive element made up of a piece of magnetostrictive material can be obtained.

Furthermore, according to the fourth aspect of this invention, an advantageous effect can be brought about in that since a magnetic circuit is provided so as to form a return arrangement, magnetic fluxes produced with excitation windings flow in the same direction so that a large output capable of producing less loss in the magnetic circuit can be obtained.

Still further, according to the fifth aspect of this invention, an advantageous effect can be brought about in that since a magnetostrictive material is formed in a rectangular-shaped core-type transformer structure, a magnetostrictive element is simple in structure and can be disposed even in a position such as the central position or the like of a rodlike body where a stacked magnetostrictive element is hard to be located, thereby enhancing mountability.

Still further, according to the sixth aspect of this invention, an advantageous effect can be brought about in that since an acoustic horn is provided, the density of energy of an ultrasonic wave is amplified and the energy whose density has been amplified is injected into a rodlike body to thereby effectively transmit the energy at a transmission level of a crystal lattice energy, thereby making it possible to efficiently transfer an exciting force to the rodlike body.

Still further, according to the seventh aspect of this invention, an advantageous effect can be brought about in that since a leading end portion of an acoustic horn is pressed against a rodlike body under a suitable pressure (pre-load), no space is defined between the leading end portion of the acoustic horn and the rodlike body, magnetostriction developed in a magnetostrictive element can be efficiently transferred to the rodlike body and there is no risk of breakage of the leading end portion due to an exciting force produced by the magnetostriction.

Still further, according to the eighth aspect of this invention, an advantageous effect can be brought about in that since a plurality of magnetostrictive elements are distorted in unison with one another, individual exciting forces are added together so that a large exciting force can be obtained as a whole.

Still further, according to the ninth aspect of this invention, an advantageous effect can be brought about in that since a single resistor common to respective excitation windings is provided, the number of parts is reduced to thereby decrease the manufacturing cost and the capacity for mounting each part can be diminished, thereby making it possible to reduce the configuration of the entire signal transmission system.

Still further, according to the tenth aspect of this invention, an advantageous effect can be brought about in that since an exciting impulse current flows at time intervals during which impulse waves are not superposed on one another, there is no interference between acoustic signals and a highly reliable signal transmission can be effected.

Still further, according to the eleventh aspect of this invention, an advantageous effect can be brought about in that since a plurality of impulse currents flow in magnetostrictive elements such that the peaks of an impact wave are in phase and superposed on one another, the peaks of the impact wave produced by the respective impulse currents are superposed on one another so that an impact wave large in amplitude as a whole can be obtained.

Still further, according to the twelfth aspect of this invention, an advantageous effect can be brought about in that since noise components are removed by a filter and a detector circuit and signal components are enhanced by the detector circuit, the S/N ratio can be improved.

Still further, according to the thirteenth aspect of this invention, an advantageous effect can be brought about in that since a signal transmitting period on the transmission side is detected and a signal to be transmitted is sampled in synchronism with the detected period, the signal can be reliably received and a stable demodulating process capable of providing a high S/N ratio can be effected.

Still further, according to the fourteenth aspect of this invention, an advantageous effect can be brought about in that since noise components are detected and signal components are processed so as to exclude the influence of the noise components, which is exerted on the signal components, a demodulating process capable of providing a satisfactory S/N ratio can be performed.

Still further, according to the fifteenth aspect of this invention, an advantageous effect can be brought about in that since a pre-stored pattern of noise components produced due to the reflection and resonance of a signal sound in a rodlike body is removed from signal components, a demodulating process capable of providing a satisfactory S/N ratio can be effected.

Still further, according to the sixteenth aspect of this invention, an advantageous effect can be brought about in that since each of acoustic signals received by a plurality of electro-acoustic transducers is converted into an electric signal, signal components can be reliably received and a stable demodulating process capable of providing a satisfactory S/N ratio can be effected.

Still further, according to the seventeenth aspect of this invention, an advantageous effect can be brought about in that since an acoustic signal is received by each magnetostrictive element and the received acoustic signal is converted into an electric signal, a highly sensitive reception can be made, a receiving system can be operated under a high-temperature environment, the sharing between a transmitter and a receiver can be made, and when they are used as a bidirectional signal transmission system, a compact and efficient signal transmission system can be constructed.

Still further, according to the eighteenth aspect of this invention, an advantageous effect can be brought about in that since sound signals propagated through a rodlike body from acoustic horns are collected and received, even a weak acoustic wave can be received.

Still further, according to the nineteenth aspect of this invention, an advantageous effect can be brought about in that since a plurality of power supply voltages are supplied from complex batteries, noise such as switching noise, etc. is not produced and the loss is reduced.

Still further, according to the twentieth aspect of this invention, an advantageous effect can be brought about in that since a signal transmission is effected such that a signal sound generated by a magnetostrictive phenomenon is propagated through a rodlike body and received by an acoustic wave receiver, the maintenance becomes easy, a signal transmission can be reliably effected even when a long drill string is used, and a pre-load required to transmit the acoustic wave to a tubular body or pipe can be sufficiently applied thereto.

Still further, according to the twenty-first aspect of this invention, an advantageous effect can be brought about in that since a signal transmission is performed such that an impulsive force produced according to an acceleration associated with the magnetostriction at the time of the abrupt occurrence or disappearance of a magnetostrictive phenomenon is transmitted to a rodlike body, an efficient electrical and mechanical acoustic coupling can be realized so that the impulsive force can be converted into a large ultrasonic energy and the transmission of a signal at a high bit rate can be effected.

Still further, according to the twenty-second aspect of this invention, an advantageous effect can be brought about in that since an impact wave is applied to a rodlike body in such a manner that the peaks thereof are put in phase with each other and superposed on one another, an impact wave large in amplitude as a whole can be obtained.

Still further, according to the twenty-third aspect of this invention, an advantageous effect can be brought about in that since noise components are calculated and the so-calculated noise components are removed from signal components, a demodulating process capable of providing a satisfactory S/N ratio can be effected.

Still further, according to the twenty-fourth aspect of this invention, an advantageous effect can be brought about in that since noise components are removed from signal components based on a pre-stored pattern of the noise components, a demodulating process capable of providing a satisfactory S/N ratio can be effected.

Still further, according to the twenty-fifth aspect of this invention, an advantageous effect can be brought about in that since each of acoustic signals is converted into an electric signal by each of a plurality of electro-acoustic transducers, signal components can be reliably received and a stable demodulating process capable of providing a satisfactory S/N ratio can be effected.

A description has been made of the preferred embodiment of this invention as has been described above. It should however be noted that these description is a merely illustrative example and many changes and modifications based on these description can be made without departing from the spirit and scope of the following claims of the invention.

What is claimed is:

1. A system for transmitting a signal, comprising:

a magnetostrictive element having magnetostrictive material for producing magnetostriction and an excitation winding around the magnetostrictive material;

a magnetostriction generation control device for driving said magnetostrictive element, said magnetostriction generation control device including a power supply for supplying a voltage, a high-frequency switching circuit for selectively transmitting the voltage, a transformer for transforming the selectively transmitted voltage from an initial value to a higher value, a second rectifier for rectifying the higher value voltage, a waveform-smoothing capacitor for storing the rectified higher value voltage, a constant voltage control circuit for controlling a voltage level of the rectified higher value voltage, a switching means for selectively transmitting the stored voltage to the magnetostrictive element as an exciting current, and a switching control circuit for controlling a switching time of the switching means;

a rodlike body for transmitting a signal wave generated by said magnetostrictive element; and an acoustic wave receiver disposed in a predetermined position of said rodlike body, for receiving said signal wave propagated through said rodlike body, converting the received signal wave into a converted signal and outputting the converted signal.

2. A system according to claim 1, wherein said exciting current has a rising speed which is at least substantially identical to a speed at which said magnetostrictive material becomes distorted.

3. A system according to claim 1, wherein said magnetostrictive material is shaped in the form of a plurality of thin plate-like elements.

4. A system according to claim 1, wherein said excitation winding forms a magnetic circuit having a return circuit configuration.

5. A system according to claim 1, wherein said magnetostrictive material has a rectangular-shaped core-type transformer structure and said excitation winding forms a closed magnetic field.

6. A system according to claim 1, wherein an acoustic horn is attached to a leading end portion of said magnetostrictive element, which extends in an acoustic wave output generating direction.

7. A system according to claim 6, further comprising means for pressing a leading end portion of said acoustic horn against said rodlike body.

8. A system according to claim 1, further comprising a tubular body having a wall surface on which a plurality of said magnetostrictive elements are disposed, and wherein said magnetostriction generation control device supplies a mutually-synchronized exciting current to the excitation windings of each of said plurality of magnetostrictive elements.

9. A system according to claim 8, wherein said resistor is series-connected to the excitation windings of said plurality of magnetostrictive elements such that a response speed of an exciting current specified by a resistance value of said resistor and an inductance of said each excitation winding is at least equal to a response speed at which the magnetostrictive material of said each magnetostrictive element is distorted.

10. A system according to claim 1, wherein said magnetostriction generation control device has an exciting impulse current generating circuit for supplying an exciting impulse current to said magnetostrictive element and said exciting impulse current generating circuit generates the exciting impulse current at time intervals during which impact waves propagated through said rodlike body are in a non-superposed state.

11. A system according to claim 1, wherein said magnetostriction generation control device has an exciting impulse current generating circuit for supplying an exciting impulse current to said magnetostrictive element and said exciting impulse current generating circuit supplies a plurality of impulse currents to said magnetostrictive elements so that the peaks of impact waves propagated through said rodlike body are in phase and superposed on one another.

12. A system according to claim 1, wherein said acoustic wave receiver comprises an electro-acoustic transducer for converting an acoustic signal into an electrical signal, a noise-removing filter and a detector circuit for suppressing noise and amplifying said electrical signal.

13. A system according to claim 1, wherein said acoustic wave receiver includes an electro-acoustic transducer for converting an acoustic signal into an electric signal, a noise-removing filter and a signal processor for electrically processing a signal, said signal processor having period detecting means for detecting a signal transmitting period and sampling means for sampling a transmitting signal in synchronism with said signal transmitting period.

14. A system according to claim 1, wherein said acoustic wave receiver includes an electro-acoustic transducer for converting an acoustic signal into an electrical signal, a noise-removing filter and a signal processor for electrically processing the electrical signal, said signal processor including noise-component calculating means for calculating noise components produced due to the reflection and resonance of signal sound propagated through said rodlike body and noise-component removing means for removing the noise components from electrical signal.

15. A system according to claim 1, wherein said acoustic wave receiver includes an electro-acoustic transducer for converting an acoustic signal into an electric signal, a noise-removing filter and a signal processor for electrically processing the electrical signal and said signal processor includes storing means for prestoring a pattern of noise components produced due to the reflection and resonance of the signal sound propagated through said rodlike body and noise-component removing means for removing the noise components prestored in said storing means from electrical signal components.

16. A system according to claim 1, wherein said acoustic wave receiver includes a plurality of electro-acoustic transducers each of which converts an acoustic signal propagated through said rodlike body into an electric signal.

17. A system according to claim 1, wherein said acoustic wave receiver includes a magnetostrictive element which serves as an electro-acoustic transducer for converting an acoustic signal propagated through said rodlike body into an electric signal.

18. A system according to claim 1, wherein said acoustic wave receiver includes at least one acoustic horn for amplifying the acoustic signal propagated through said rodlike body and an electro-acoustic transducer secured to said at least one acoustic horn for converting the amplified acoustic signal into an electric signal.

19. A system according to claim 1, wherein said acoustic wave receiver includes power supply means for generating a plurality of power supply voltages.

20. A method of transmitting a signal, comprising the steps of:

supplying a voltage;

selectively transmitting the voltage through a switching circuit;

transforming the selectively transmitted voltage from an initial value to a higher value;

rectifying the higher value voltage;

storing the rectified higher value voltage in a storage capacitor;

controlling the voltage level of the rectified higher value voltage;

selectively transmitting the stored voltage to a magnetostrictive element an exciting current to generate a signal sound;

propagating the signal sound through a rodlike body; and receiving the signal sound by an acoustic wave receiver disposed in a predetermined position of said rodlike body.

21. A method according to claim 20, wherein the step of selectively transmitting the stored voltage selectively generates and eliminates magnetostriction and produces an impulsive force according to an acceleration selectively corresponding to the generation and elimination of magnetostriction through said rodlike body as an acoustic signal.

22. A method according to claim 21, further comprising the step of applying the impulsive force produced by the magnetostriction to said rodlike body a plurality of times as impact waves, the peaks of the impact waves propagated through said rodlike body being in phase and superposed on one another.

23. A method according to claim 20, wherein said acoustic wave receiver converts an acoustic signal into an electric signal, calculates noise components produced due to the reflection and resonance of the signal sound propagated through said rodlike body and removes the calculated noise components from the electric signal.

24. A method according to claim 20, wherein said acoustic wave receiver converts an acoustic signal into an electric signal and removes noise components from the electric signal.

25. A method according to claim 20, wherein said acoustic wave receiver is provided with a plurality of electro-acoustic transducers each of which converts an acoustic signal propagated through said rodlike body into an electric signal.

* * * * *